US007658318B2

(12) United States Patent
Walsh et al.

(10) Patent No.: US 7,658,318 B2
(45) Date of Patent: Feb. 9, 2010

(54) PACKAGES, BLANKS FOR MAKING PACKAGES AND ASSOCIATED METHODS

(75) Inventors: Joseph C. Walsh, Boulder, CO (US); Robert L. Conatser, Golden, CO (US); Raymond S. Kastanek, Longmont, CO (US); Kelly R. Fitzwater, Lakewood, CO (US); Weston R. Wilson, Arvada, CO (US)

(73) Assignee: Graphic Packaging International, Inc., Marietta, GA (US)

( * ) Notice: Subject to any disclaimer, the term of this patent is extended or adjusted under 35 U.S.C. 154(b) by 68 days.

(21) Appl. No.: 11/448,620

(22) Filed: Jun. 7, 2006

(65) Prior Publication Data

US 2006/0283928 A1 Dec. 21, 2006

Related U.S. Application Data

(60) Provisional application No. 60/688,505, filed on Jun. 8, 2005, provisional application No. 60/724,537, filed on Oct. 7, 2005.

(51) Int. Cl.
*B65D 17/28* (2006.01)
*B65D 5/32* (2006.01)

(52) U.S. Cl. ..... 229/225; 229/122.32; 229/231

(58) Field of Classification Search ..... 229/224, 229/225, 226, 227, 228, 229, 231, 232, 233, 229/234, 122.32, 122.33
See application file for complete search history.

(56) References Cited

U.S. PATENT DOCUMENTS 1,145,668 A 7/1915 Brown
1,478,791 A 12/1923 Nelson
1,762,703 A 6/1930 Smith
1,844,952 A 2/1932 Freedman et al.
1,869,751 A 8/1932 Iacobitti
1,911,215 A 5/1933 Walter
2,005,924 A 6/1935 Wilson
2,006,203 A 6/1935 Leslie
2,098,818 A * 11/1937 Andrews ..... 229/225
2,343,222 A 2/1944 Nelson
2,346,134 A 4/1944 Kirkland et al.
2,348,377 A * 5/1944 Goodyear ..... 229/225
2,407,781 A 9/1946 Guyer
2,502,117 A 3/1950 Anderson
2,576,594 A 11/1951 Goldstein
2,701,679 A 2/1955 Goldstein
2,706,076 A 4/1955 Guyer
2,775,393 A 12/1956 Rugg
2,778,557 A 1/1957 Moore
2,848,151 A 8/1958 O'Neil
2,934,251 A 4/1960 Kramer
2,944,726 A * 7/1960 McCauley ..... 229/131
2,993,632 A 7/1961 De Feo
3,048,324 A * 8/1962 Anderson ..... 229/207

(Continued)

FOREIGN PATENT DOCUMENTS

DE 1091851 10/1960

(Continued)

*Primary Examiner*—Gary E Elkins
(74) *Attorney, Agent, or Firm*—Womble Carlyle Sandridge & Rice, PLLC

(57) ABSTRACT

Cartons are formed from two or more continuous webs that can individually or concurrently provided with cuts, scores, or other lines of disruption.

33 Claims, 29 Drawing Sheets

U.S. PATENT DOCUMENTS

| | | | | | |
|---|---|---|---|---|---|
| 3,116,866 | A | | 1/1964 | Boran | |
| 3,137,437 | A | | 6/1964 | Svensson | |
| 3,159,326 | A | | 12/1964 | Stonebanks | |
| 3,184,136 | A | | 5/1965 | Forbes, Jr. | |
| 3,414,182 | A | | 12/1968 | Fobiano | |
| 3,417,911 | A | * | 12/1968 | Hennessey | 229/117.14 |
| 3,640,447 | A | | 2/1972 | Forbes, Jr. et al. | |
| 3,768,719 | A | | 10/1973 | Johnson | |
| 3,831,836 | A | | 8/1974 | Ellison et al. | |
| 3,891,137 | A | | 6/1975 | Ellison et al. | |
| 3,905,646 | A | | 9/1975 | Brackmann et al. | |
| 3,951,333 | A | | 4/1976 | Forbes, Jr. et al. | |
| 3,981,430 | A | | 9/1976 | Keim | |
| 4,015,768 | A | | 4/1977 | McLennan | |
| 4,027,794 | A | | 6/1977 | Olson | |
| 4,046,307 | A | | 9/1977 | Booth et al. | |
| 4,095,735 | A | | 6/1978 | Stone | |
| 4,141,485 | A | | 2/1979 | Lambert | |
| 4,165,030 | A | | 8/1979 | Bunger et al. | |
| 4,168,003 | A | | 9/1979 | Wysocki | |
| 4,194,677 | A | | 3/1980 | Wysocki | |
| 4,308,956 | A | | 1/1982 | Steinke et al. | |
| 4,341,338 | A | | 7/1982 | Arnold | |
| 4,345,393 | A | | 8/1982 | Price et al. | |
| 4,371,109 | A | | 2/1983 | Tanner et al. | |
| 4,458,810 | A | | 7/1984 | Mahoney | |
| 4,548,318 | A | * | 10/1985 | Boyle | 229/221 |
| 4,608,038 | A | | 8/1986 | Virta et al. | |
| 4,768,703 | A | | 9/1988 | Sosler et al. | |
| 4,781,317 | A | | 11/1988 | Ditto | |
| 4,909,395 | A | | 3/1990 | Weissman | |
| 4,913,292 | A | * | 4/1990 | Field | 229/231 |
| 4,946,540 | A | | 8/1990 | Mitchard | |
| 4,948,033 | A | | 8/1990 | Halsell, II et al. | |
| 4,989,735 | A | | 2/1991 | O'Brien | |
| 5,012,959 | A | | 5/1991 | Gordon | |
| 5,050,742 | A | | 9/1991 | Muckenfuhs | |
| 5,069,359 | A | | 12/1991 | Liebel | |
| 5,071,010 | A | | 12/1991 | Carufel/Zeman | |
| 5,083,667 | A | | 1/1992 | Holder | |
| 5,092,516 | A | | 3/1992 | Kastanek | |
| 5,125,568 | A | | 6/1992 | Bauer | |
| 5,129,875 | A | | 7/1992 | Chaygneaud-Dupuy | |
| 5,141,150 | A | | 8/1992 | Plaessman | |
| 5,222,660 | A | | 6/1993 | Koss | |
| 5,238,181 | A | | 8/1993 | Mahler | |
| 5,251,808 | A | | 10/1993 | Rudd | |
| 5,285,956 | A | | 2/1994 | Piepho | |
| 5,328,091 | A | * | 7/1994 | Koss | 229/231 |
| 5,373,960 | A | * | 12/1994 | Gunn et al. | 229/117.25 |
| 5,429,297 | A | | 7/1995 | Walsh | |
| 5,450,680 | A | | 9/1995 | Bromberg | |
| 5,544,806 | A | | 8/1996 | Anderson et al. | |
| 5,551,938 | A | | 9/1996 | Stone | |
| 5,584,430 | A | * | 12/1996 | Mulry | 229/117.16 |
| 5,588,585 | A | | 12/1996 | McClure | |
| 5,599,267 | A | | 2/1997 | Dupuy | |
| 5,601,521 | A | | 2/1997 | Plamas Xapelli | |
| 5,632,404 | A | | 5/1997 | Walsh | |
| 5,678,755 | A | | 10/1997 | Block | |
| 5,757,930 | A | | 5/1998 | Seidemann et al. | |
| 5,775,576 | A | * | 7/1998 | Stone | 229/225 |
| 5,794,811 | A | | 8/1998 | Walsh | |
| 5,810,250 | A | | 9/1998 | Stone et al. | |
| 5,826,783 | A | | 10/1998 | Stout | |
| 5,857,614 | A | | 1/1999 | Walsh | |
| 5,893,513 | A | | 4/1999 | Stone et al. | |
| 5,967,374 | A | | 10/1999 | Baker | |
| 6,015,084 | A | | 1/2000 | Mathieu et al. | |
| 6,027,018 | A | | 2/2000 | Yocum | |
| 6,059,182 | A | | 5/2000 | Wein | |
| 6,110,095 | A | | 8/2000 | Finke et al. | |
| 6,131,729 | A | | 10/2000 | Eckerman et al. | |
| 6,145,736 | A | | 11/2000 | Ours et al. | |
| 6,158,653 | A | | 12/2000 | Kanter et al. | |
| 6,189,777 | B1 | | 2/2001 | Hutchinson | |
| 6,221,192 | B1 | | 4/2001 | Walsh | |
| 6,230,881 | B1 | | 5/2001 | Collura | |
| 6,332,488 | B1 | | 12/2001 | Walsh | |
| 6,435,402 | B1 | | 8/2002 | Hengami | |
| 6,631,803 | B2 | | 10/2003 | Rhodes et al. | |
| 6,689,034 | B2 | | 2/2004 | Walsh | |
| 6,889,892 | B2 | | 5/2005 | Walsh et al. | |
| 6,948,293 | B1 | | 9/2005 | Eckermann et al. | |
| 2001/0048022 | A1 | | 12/2001 | Zoeckler | |
| 2002/0055429 | A1 | | 5/2002 | Walsh | |
| 2002/0060240 | A1 | | 5/2002 | Walsh | |
| 2005/0103681 | A1 | | 5/2005 | Aubry et al. | |

FOREIGN PATENT DOCUMENTS

| | | | | |
|---|---|---|---|---|
| DE | 89 08 393 | U1 | | 9/1989 |
| EP | 0 079 155 | A2 | | 5/1983 |
| EP | 0 542 449 | A1 | | 5/1993 |
| FR | 2686316 | A1 | * | 7/1993 |
| GB | 2 275 913 | A | | 9/1994 |
| GB | 2 379 923 | A | | 3/2003 |
| JP | 44-25911 | | | 10/1969 |
| WO | WO 92/01606 | A1 | | 2/1992 |
| WO | WO 97/27114 | | | 7/1997 |
| WO | WO 02/11516 | A1 | | 2/2002 |
| WO | WO 03/051622 | A | | 6/2003 |

* cited by examiner

PACKAGES, BLANKS FOR MAKING PACKAGES AND ASSOCIATED METHODS

RELATED APPLICATIONS

This application claims the benefit of U.S. Provisional Application No. 60/688,505, filed Jun. 8, 2005, and U.S. Provisional Application No. 60/724,537, filed Oct. 7, 2005, the entire contents of both documents being hereby incorporated by reference.

BACKGROUND

Conventional cartons may include features such as closure devices, lids, and other convenient features. Features of a certain complexity, however, may require the carton blank to be prepared in a batch process, where features or articles can be individually cut and/or glued to the carton blank. Batch processing is slow when compared to continuous processes, and may involve higher costs.

SUMMARY

According to a first exemplary embodiment of the invention, a carton is formed from an inner blank adhered to an outer blank. A lid pattern is formed at least in the outer blank and defines a pivotable lid in a top portion of the carton. When opened, the lid separates from the inner blank and can be pivoted between open and closed positions.

According to one aspect of the first embodiment, the inner blank forms a sleeve lining an inner surface of the outer blank. The inner blank increases the strength of the carton.

According to another aspect of the first embodiment, a latch feature can be formed in the carton that allows the lid to be selectively opened and closed. The latch feature can incorporate portions of the inner and outer blank that interact to maintain the lid in a closed position.

According to yet another aspect of the first embodiment, the inner blank can be provided with a tear-away section that is removable after opening the pivotable lid. The carton is therefore opened in two stages, with the inner blank forming a vessel separate from the outer blank.

According to a second exemplary embodiment of the invention, carton blanks can be formed in a continuous process where outer and inner webs are individually and/or simultaneously provided with differing, repeating patterns of disruption. The outer and inner webs are joined together in the continuous process to form carton blanks that have one or more multi-ply sections.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

Figure 1:
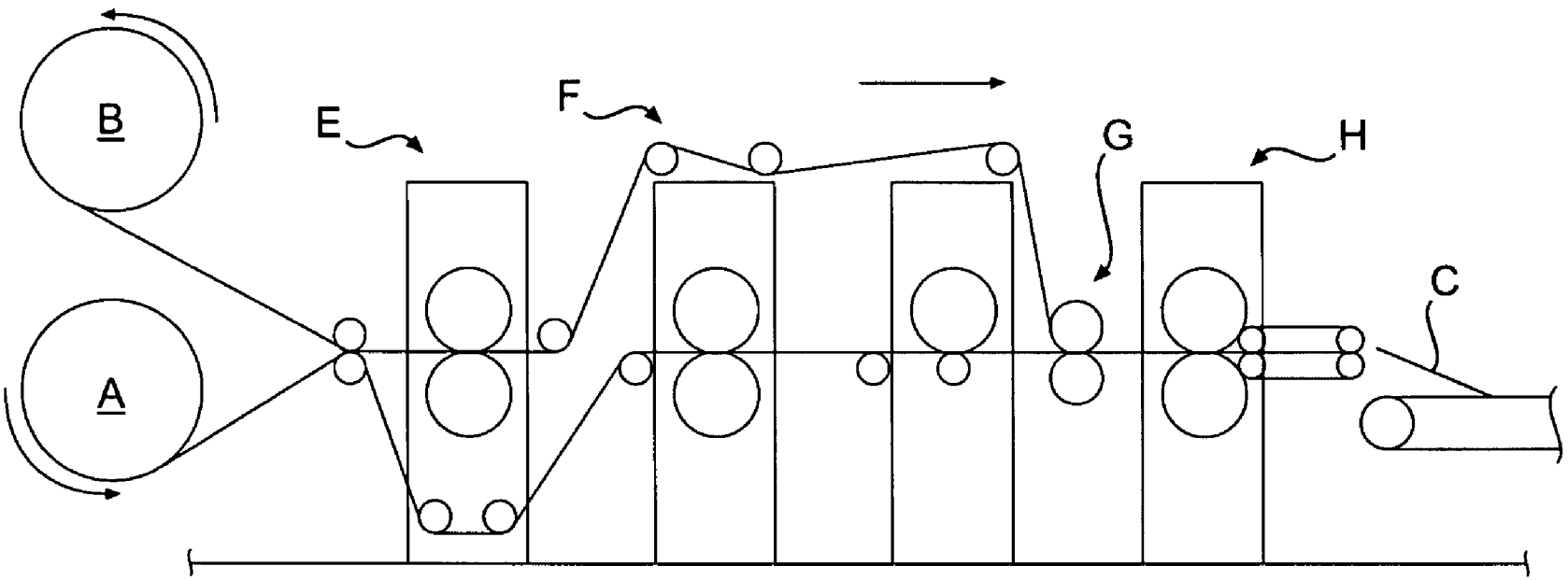
FIG. 1 is a schematic illustration of a continuous process production line.

FIG. 1 is a schematic illustration of a continuous process production line suitable for producing blanks according to the embodiments disclosed in this specification. In FIG. 1, a web of material B is repeatedly provided with one or more lines of disruption at a first disrupting station E, and a web of material A is repeatedly provided with one or more lines of disruption at a second disrupting station F. The webs of material A, B may then be laminated together at a lamination station G, and passed through a third disrupting station H. The laminated webs may be separated into individual two-ply carton blanks C at the third disruption station H, and also, if desired, provided with additional lines of disruption. The combined webs are generally separated into the individual blanks C at the points between the repeating patterns of lines of disruption.

In general, each of the cartons discussed herein can be formed from exterior (or outer) and interior (or inner) webs, which are indicated by reference signs A and B in FIG. 1, respectively. The terms "inner" and "outer" are used in this specification to indicate the location of the respective webs (and corresponding blank plys) in a product, such as a carton, formed or erected from the finished multi-ply blanks C. The outer and inner webs A and B may each be individually provided with one or more lines of disruption prior to laminating the webs together. Unless specifically stated otherwise, the plan views of final blanks of this specification illustrate blanks having significant portions with at least two plys (i.e., "multi-ply") formed from individual webs A and B, such as the two-ply blank C shown in FIG. 1.

Figure 2:
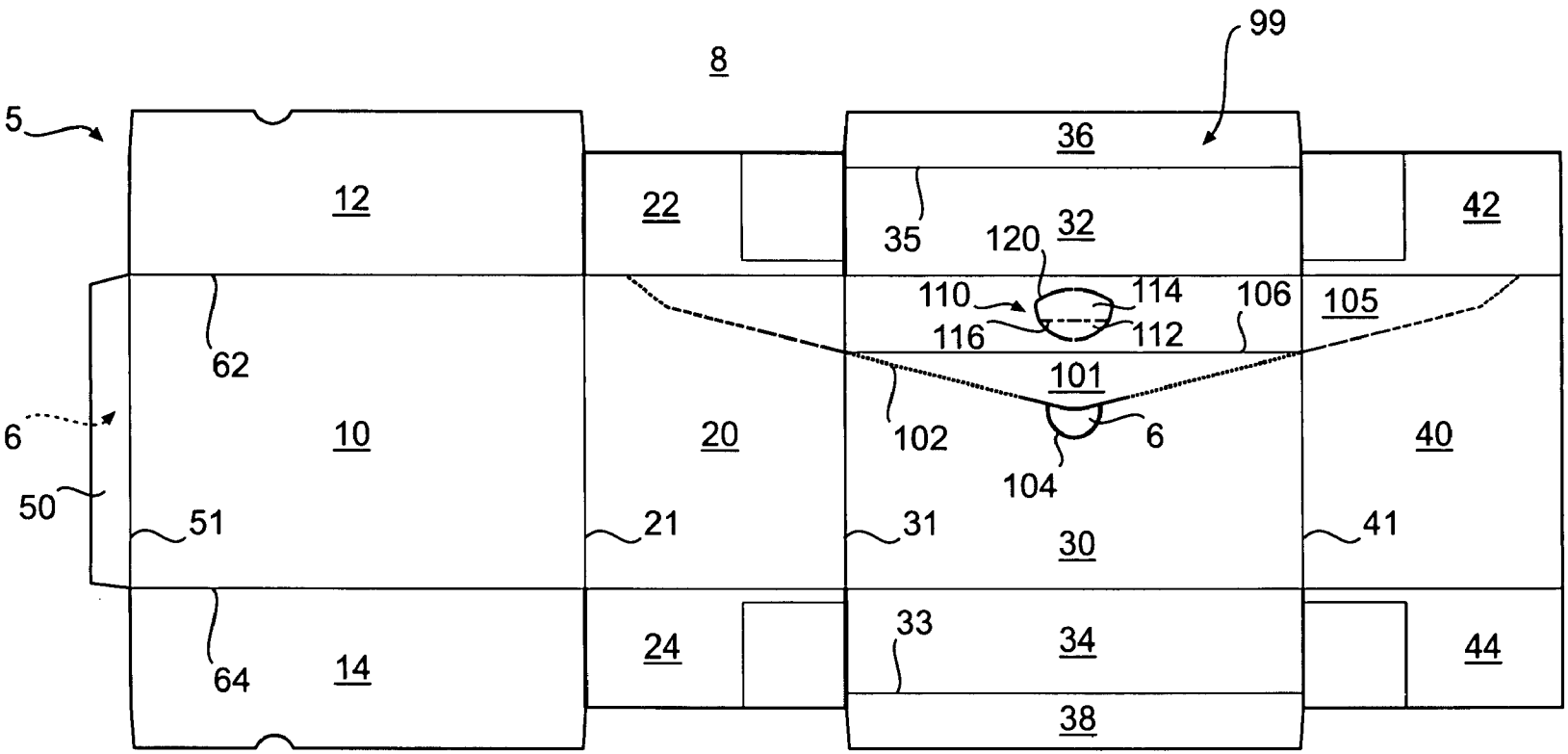
FIG. 2 is a plan view of a blank used to form a carton according to a first embodiment of the invention.

FIG. 2 is a plan view of a final two-ply blank 8 used to form a carton 150 (illustrated in FIG. 4A) according to a first embodiment of the invention. The blank 8 is formed from an outer blank 5 and an inner blank 6 adhered, laminated or otherwise joined to the outer blank 5. The outer surface or print surface of the outer blank 5 is visible in FIG. 2, and the inner blank 6 is joined to the opposite, interior or underside of the outer blank 5. The inner blank 6 is generally located between the longitudinal fold lines 62, 64 on the opposite side of the blank 8. Because the inner blank 6 is generally not visible in FIG. 2, the lead line indicating the inner blank 6 is indicated by dashed lines. In general, the outer blank 5 may be formed from a continuous web such as the web A shown in FIG. 1, and the inner blank 6 may be formed from a separate, continuous web B. The webs A and B undergo processing in the production line of FIG. 1, including lamination together at station G, and separation into a final two-ply blank 8 at the third disruption station H.

The blank 8 comprises a back panel 10 foldably connected to a first end panel 20 at a first transverse fold line 21, a front panel 30 foldably connected to the first end panel 20 at a second transverse fold line 31, and a second end panel 40 foldably connected to the front panel 30 at a third transverse fold line 41. An adhesive flap 50 can be foldably connected to the back panel 10 at a fourth transverse fold line 51. The transverse fold lines 21, 31, 41 can be formed by, for example, cuts or scores extending through both the inner and outer blanks 6, 5. Generally, the blank 8 is two-ply at the sections defined by the panels 10, 20, 30, 40 between the longitudinal fold lines 62, 64. The remaining sections of the blank 8 may be comprised largely or solely of the outer blank 5 and formed from an exterior web A as shown in FIG. 1.

The back panel 10 is foldably connected to a top back flap 12 and a bottom back flap 14. The first end panel 20 is foldably connected to first top end flap 22 and a first bottom end flap 24. The front panel 30 is foldably connected to a front top flap 32 and a front bottom flap 34. The second end panel 40 is foldably connected to a second top end flap 42 and a second bottom end flap 44. When the carton 150 (FIG. 4A) is assembled, the end flaps 12, 22, 32, 42 close a top of the carton 150, and the end flaps 14, 24, 34, 44 close a bottom of the carton 150. The top flaps 12, 22, 32, 42 extend along a first or top marginal area of the blank 8, and may be foldably connected at the first longitudinal fold line 62 that extends along the length of the blank 8. The bottom flaps 14, 24, 34, 44 extend along a second or bottom marginal area of the blank 8, and may be foldably connected at the second longitudinal fold line 64 that also extends along the length of the blank 8. The longitudinal fold lines 62, 64 may be straight fold lines, or may be offset at one or more locations to account for, for example, blank thickness or other factors. The front top flap 32 can include a fold line 35 defining a base panel 36.

Figure 4A:
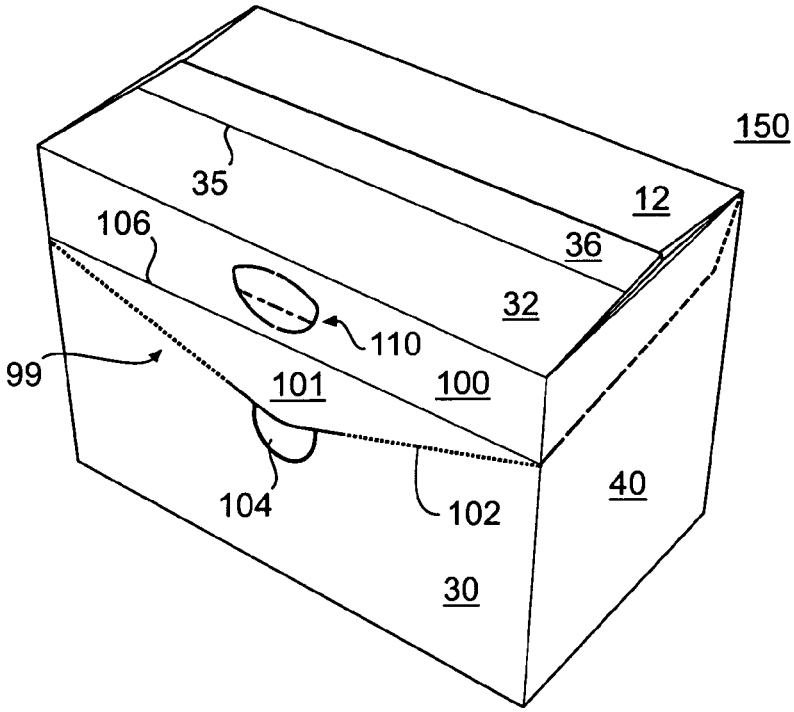
FIGS. 4A and 4B illustrate the first carton embodiment.

The outer blank 5 is provided with a lid pattern 99 that defines a pivotable lid 100 in the carton 150 (illustrated in FIG. 4A). The lines of disruption forming the lid pattern 99 generally do not extend into the inner blank 6 and can be formed in the outer web A before lamination to the inner web B. The lid pattern 99 includes a line of disruption such as a cut or breachable perforation 102 that extends across the panels 20, 30, 40 and defines the bottom edge of a bottom front flap 101 of the lid 100. A longitudinal fold line 106 defines an upper edge of the bottom front flap 101 and a bottom edge of an upper front wall 105 of the lid 100. A click-shut latch 110 is formed in the outer blank 5, and has an outer perimeter defined by a breachable line of disruption 120. A base portion 114 of the click-shut latch 110 is connected to a latch tab or flap 112 at a fold line 116. The pivotable lid 100 is comprised of sections of the outer blank 5, and is generally not adhered to the inner blank 6, except at the base 114. An access cutout 104 may be formed in the outer blank 5 at the bottom edge of the bottom front flap 101. In FIG. 2, a small portion of the inner blank 6 is visible through the access cutout 104 in the outer blank 5.

Figure 3A:
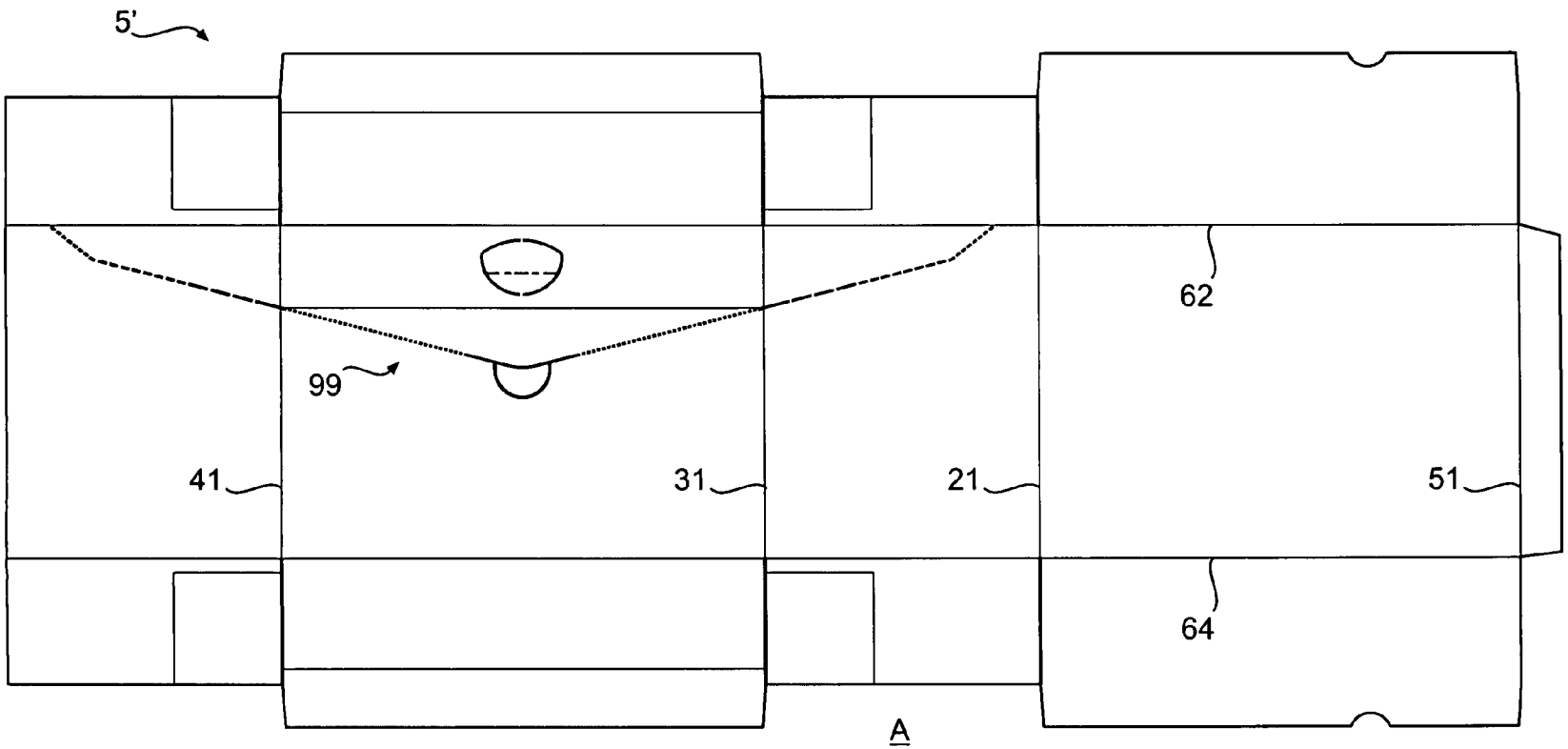
FIGS. 3A-3D illustrate blank formation and erection of the first carton embodiment.

FIGS. 3A-3D illustrate an exemplary method of blank formation and erection of the carton 150. FIG. 3A is a plan view of the inner or interior surface of a partially completed section 5' of the continuous outer web A during formation of one of a continuous series of outer blanks 5, before the outer blank sections 5' are joined to inner blank sections 6'. In FIG. 3A, the web A is continuous and the vertical line at the far left of the section 5' and the vertical line at the far right of the section will not be formed until station H. The vertical lines are included merely to illustrate conceptual right and left boundaries of the section 5'. A single outer blank section 5' is shown in FIG. 3A, although an essentially continuous series of partially completed outer blank sections 5' will be formed in the outer web A as the web is processed. The repeating patterns of lines of disruption formed in the web A in FIG. 3A may take place, for example, at the disrupting station F shown in FIG. 1. During lamination, the inner blanks will overlie the inner surface of the outer web A between the fold lines 62, 64. As shown in FIG. 3A, substantially all of the lines of disruption formed in the outer blank sections 5' may be formed at the disrupting station F. If desired, for example, the fold lines 21, 31, 41, 51 can be formed further downstream in the process, such as simultaneously in the inner and outer blank sections after lamination.

Adhesive, glue or other material used in lamination may be applied at the base portion 114 of the latch 110 so that the inner blank 6 is adhered, laminated or otherwise joined to the base portion 114 in the completed blank 8. All or substantially all of a remainder of the area inside the lid pattern 99 in the outer blank 5 is not adhered to the inner blank 6. During processing, the area of the outer blank 5' (FIG. 3A) outside of the lid pattern 99, between the fold lines 62, 64, can be provided with adhesive at selected locations in order to adhere or otherwise join the inner blank 6' to the outer blank 5'.

Figure 3B:
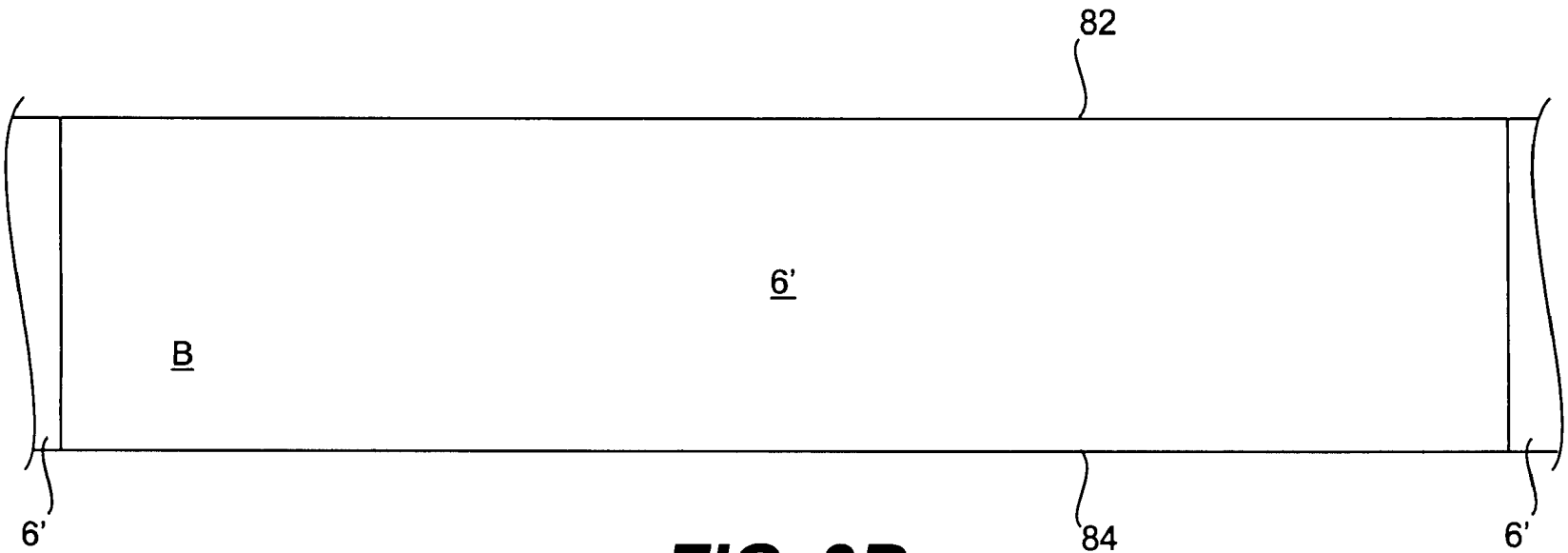

FIG. 3B is a plan view of the continuous inner web B during formation of one of a continuous series of inner blanks 6. The lines of disruption formed in the web B in FIG. 3B may take place at the disrupting station E shown in FIG. 1, and the partially completed inner blanks in series are indicated by the reference number 6'. In FIG. 3B, the web B is continuous and the vertical line at the far left of the section 6' and the vertical line at the far right of the section will not be formed until station H. The vertical lines are included merely to illustrate conceptual right and left boundaries of the section 6'. The inner web B has longitudinal upper and lower edges 82 and 84. The width of the web B is selected to generally conform to the width between the longitudinal fold lines 62, 64 in the web A. The width of the web B may be, for example, slightly less than the width between the fold lines 62, 64 so that the end flaps of the completed blank 8 can be easily folded at the fold lines 62, 64. Any type of line of disruption can be formed at the station E. For example, the width of the web B can be trimmed at station E to form the edges 82, 84. Also, if desired, portions of the fold lines 21, 31, 41 could be formed at the station E.

Figure 3C:
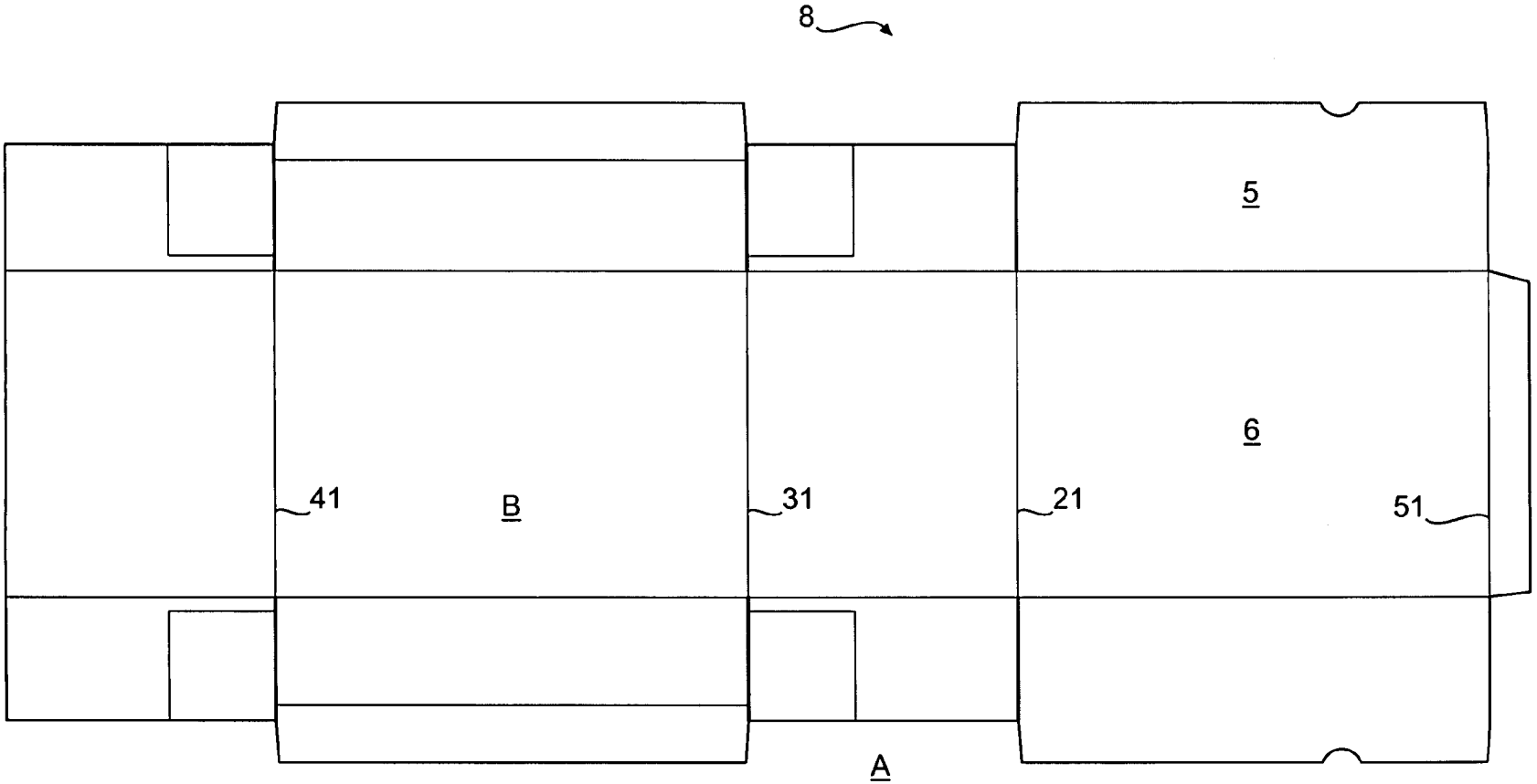

FIG. 3C illustrates the inner web B laminated to the outer web A, and final lines of disruption formed in the combined two-ply web to form the two-ply blanks 8 from the repeating series of inner and outer blanks 6, 5. The interior side of the blank 8 is shown FIG. 3C, so the entirety of the inner blank 6 is visible. Lamination of the inner web A to the outer web B can take place at station G in FIG. 1. Final operations on the web A/web B laminate can be performed at the disrupting station H in FIG. 1. For example, the fold lines 21, 31, 41, as well as other lines of disruption, may be formed simultaneously in the outer and inner webs 5, 6 at station H. Cutting of the laminated web sections into individual blanks 8 can also be performed at station H. In general, cutting into individual blanks 8 occurs in the webs A and B between the points at which the patterns of disruption in each web repeat.

Figure 3D:
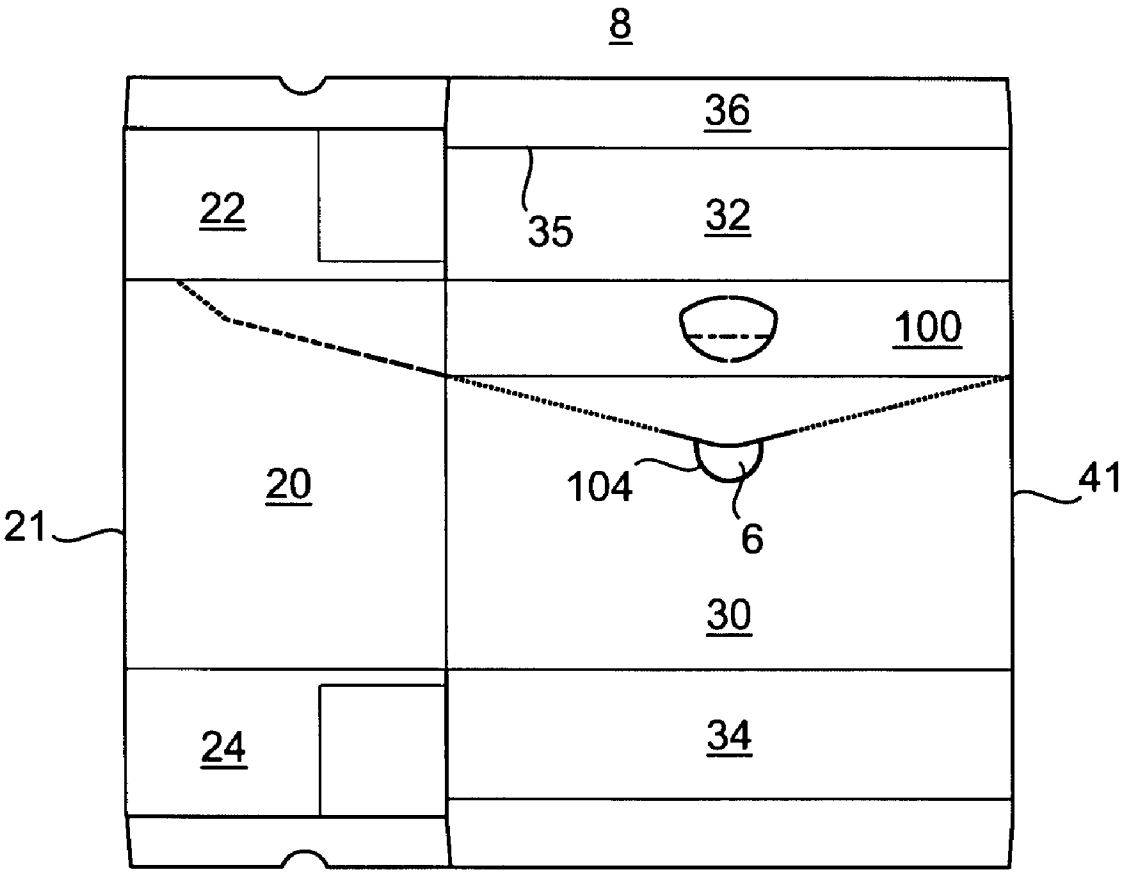

Referring also to FIG. 2, FIG. 3D illustrates adhering of the interior side of the second end panel 40 to the exterior side of the adhesive flap 50 by folding at the transverse fold lines 21, 41 in the blank 8. The blank 8 can now be opened up into a generally tubular form. The bottom end of the tubular blank form is closed by folding the flaps 24, 44 inwardly and then folding the flaps 14, 34 over the flaps 24, 44. The flaps 14, 34 can be adhered to the flaps 24, 44 by adhesives such as, for example, glue. Similarly, the top flaps 22, 42 are folded inwardly, and the flap 12 is folded over the flaps 22, 42. The flap 32 is then folded over the flaps 12, 22, 42. The flaps 12, 22, 32, 42 can be adhered together by, for example, adhesive.

Figure 4B:
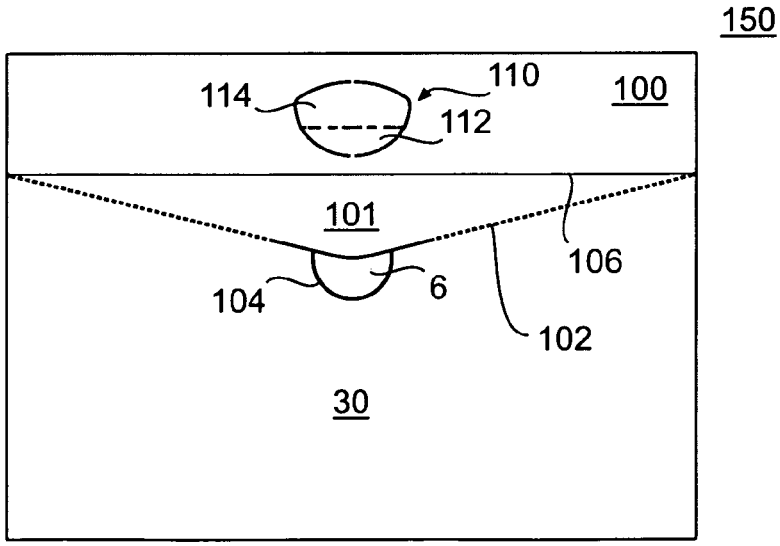

FIGS. 4A and 4B illustrate the carton 150 erected from the blank 8. Product, such as particulate detergents, discrete articles, or other items, may be packed into the carton 150 at any time before closing the top and bottom ends of the carton. The carton 150 is generally parallelepipedal in shape and may be formed such that there are no gaps between the laminated plies of the carton. The lid pattern 99 defines a pivotable lid 100 in the carton that when opened, allows dispensing of product within the carton. The inner blank 6 provides reinforcement for the carton 150 that greatly increases the strength of the carton under axial compression.

Figure 5A:
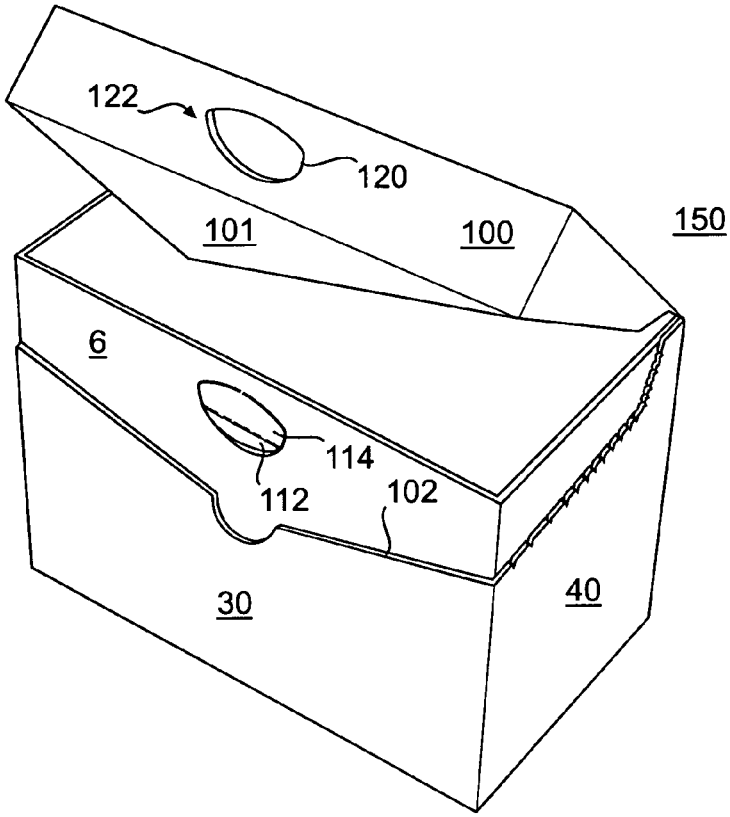
FIGS. 5A and 5B illustrate opening and closing of a pivotable lid of the first carton embodiment.
Figure 5B:
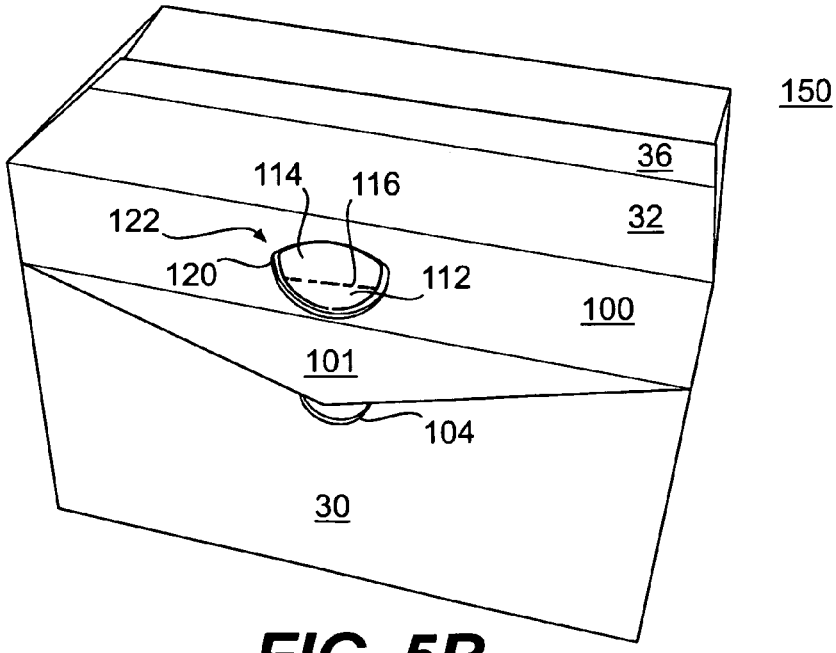

FIGS. 5A and 5B illustrate opening and closing of the pivotable lid 100. Referring to FIG. 5A, the lid 100 may be opened by accessing the bottom tip of the bottom flap 101 of the lid 100 at the cutout 104, and pulling the bottom flap 101 so that the outer blank 5 tears along the cut or perforation 102 in the outer blank 5. If perforations are used to form the perimeter 120, the user may also press in at the base 114 and/or tab 112 to pre-break the perforation 120. The lid 100 can then be pivoted upwardly to open the carton 150, as shown in FIG. 5A. The base 114 of the latch 110 is joined to the inner blank 6 and separates from the remainder of the lid 100, which creates a latch aperture or opening 122 in the front wall 105 from the cut or perforation 120. The latch tab 112 remains attached to the base 114 and also separates from the lid 100. The inner blank 6 may remain intact and constitutes an inner shell or sleeve in the interior of the carton 150.

Referring to FIG. 5B, the lid 100 may be reclosed by first bending the latch tab 112 upwardly at the fold line 116 so that the latch tab 112 projects outwardly from the inner blank 6 in a latching position. Alternatively, opening of the lid 100 may be sufficient to bend the latch tab 112 to its latching position. It is not required that the latch tab 112 bend outwardly. The lid 100 is pivoted downwardly and selectively secured in a closed state by engaging the latch tab 112 with the perimeter of the latch opening 122. The lid 100 can be opened again by lifting upwardly on the bottom flap 101 to disengage the latch tab 112 from the latch opening 122. According to the above embodiment, the latch tab 112 can emit an audible noise, such as a 'click,' when the tab 112 is engaged and/or disengaged with the latch opening 122.

Figure 6:
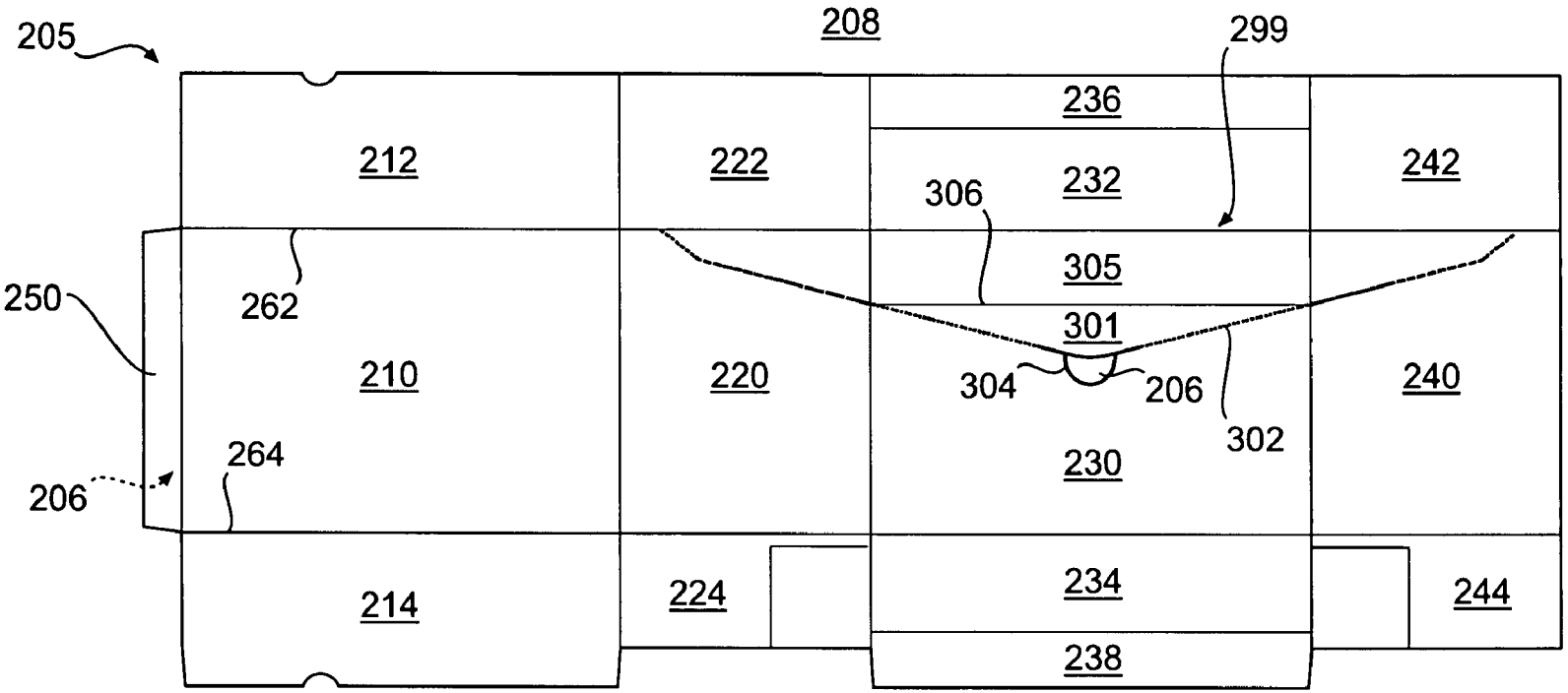
FIG. 6 is a plan view of a blank used to form a carton according to a second embodiment of the invention.

FIG. 6 is a plan view of two-ply blank 208 used to form a carton 350 according to a second embodiment of the invention. The blank 208 is generally similar to the blank 8 illustrated in FIG. 2, with elements in the blank 208 indicated by reference numbers similar to those in the blank 8, preceded by a "2" or "3." The blank 208 is formed from an outer blank 205 and an inner blank 206 adhered, laminated or otherwise joined to the outer blank 205. The outer surface or print surface of the outer blank 205 is visible in FIG. 6, and the inner blank 206 is joined to the opposite, underside of the outer blank 205. The lead line of the reference number 206 is therefore indicated by dashed lines. The inner blank 206 may be wholly or substantially identical to the inner blank 6. In general, as in the case of the blank 8, the outer blank 205 may be formed from a continuous web such as the web A shown in FIG. 1, and the inner blank 206 may be formed from a continuous web B. The webs A and B undergo processing in the production line, including lamination together at the station G, and separation into a final two-ply blank 208 at the disruption station H.

The blank 208 includes a lid pattern 299 comprising lines of disruption that differs from the lid pattern 99 of the blank 8 in that there is no click-shut latch in the blank 208. The lid pattern 299 defines a pivotable lid 300 in the carton 350 (illustrated in FIG. 7A). The lid pattern 299 includes a breachable line of disruption, such as a perforation, or a cut 302 that extends across the panels 220, 230, 240 and that defines the bottom edge of a bottom front flap 301 of the lid 300. A longitudinal fold line 306 defines an upper edge of the bottom front flap 101 and a bottom edge of an upper front wall 305 of the lid 300. An access cutout 304 may be formed in the outer blank 205 at the bottom edge of the bottom front flap 301. A portion of the inner blank 206 is visible through the access cutout 304 in the outer blank 205. The inner blank 206 may be adhered to the outer blank 205 in the sections of the blank 205 between the fold lines 262, 264, and outside of the lid pattern 299.

The blank 208 can be formed in a manner similar to the blank 8, with the outer blank 205 differing from the outer blank 5 in that no click-shut latch is formed in the outer blank 205. The blank 208 can be formed into the carton 350 in manner similar to forming the blank 8 into the carton 150, as discussed above.

Figure 7A:
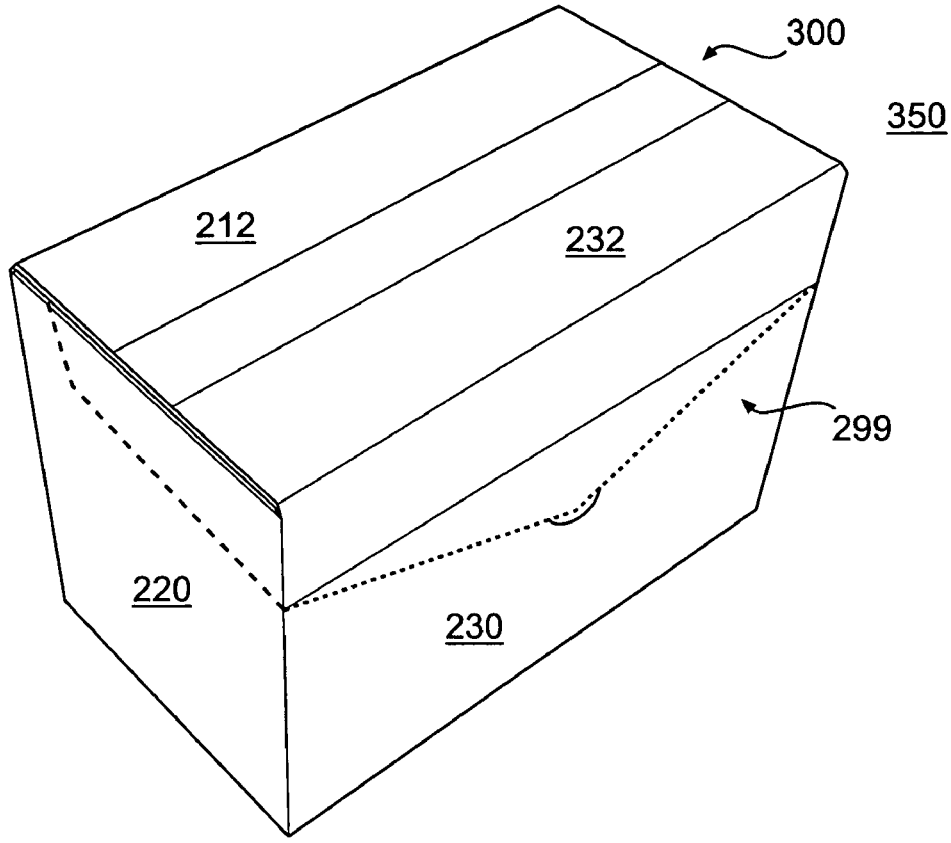
FIGS. 7A and 7B illustrate the second carton embodiment.
Figure 7B:
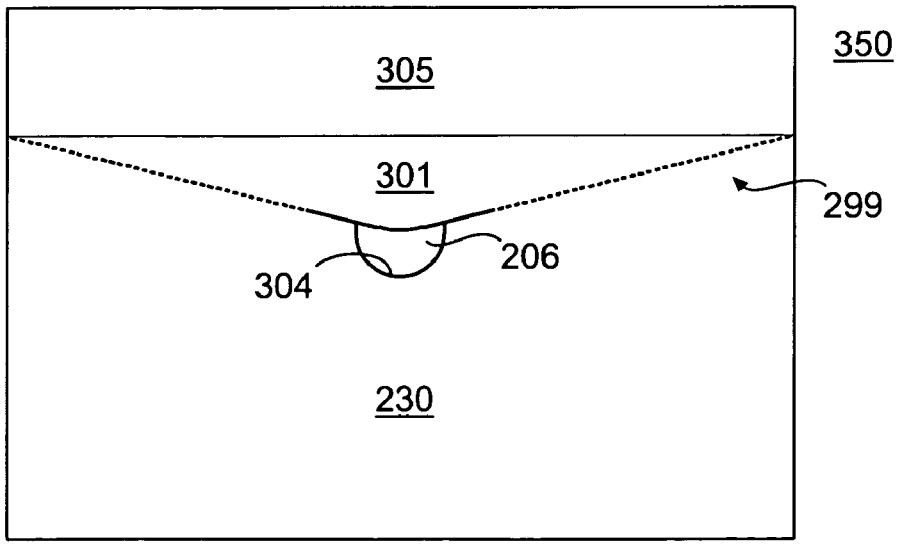

FIGS. 7A and 7B illustrate the carton 350 erected from the blank 208. Product, such as particulate detergents, discrete articles, or other items, may be loaded into the carton 350 at any time before closing the top and bottom ends of the carton. The carton 350 is generally parallelepipedal in shape and may be formed such that there are no gaps between the laminated plies of the carton. The lid pattern 299 defines a pivotable lid 300 in the carton 350 that when opened, allows dispensing of product within the carton.

Figure 8A:
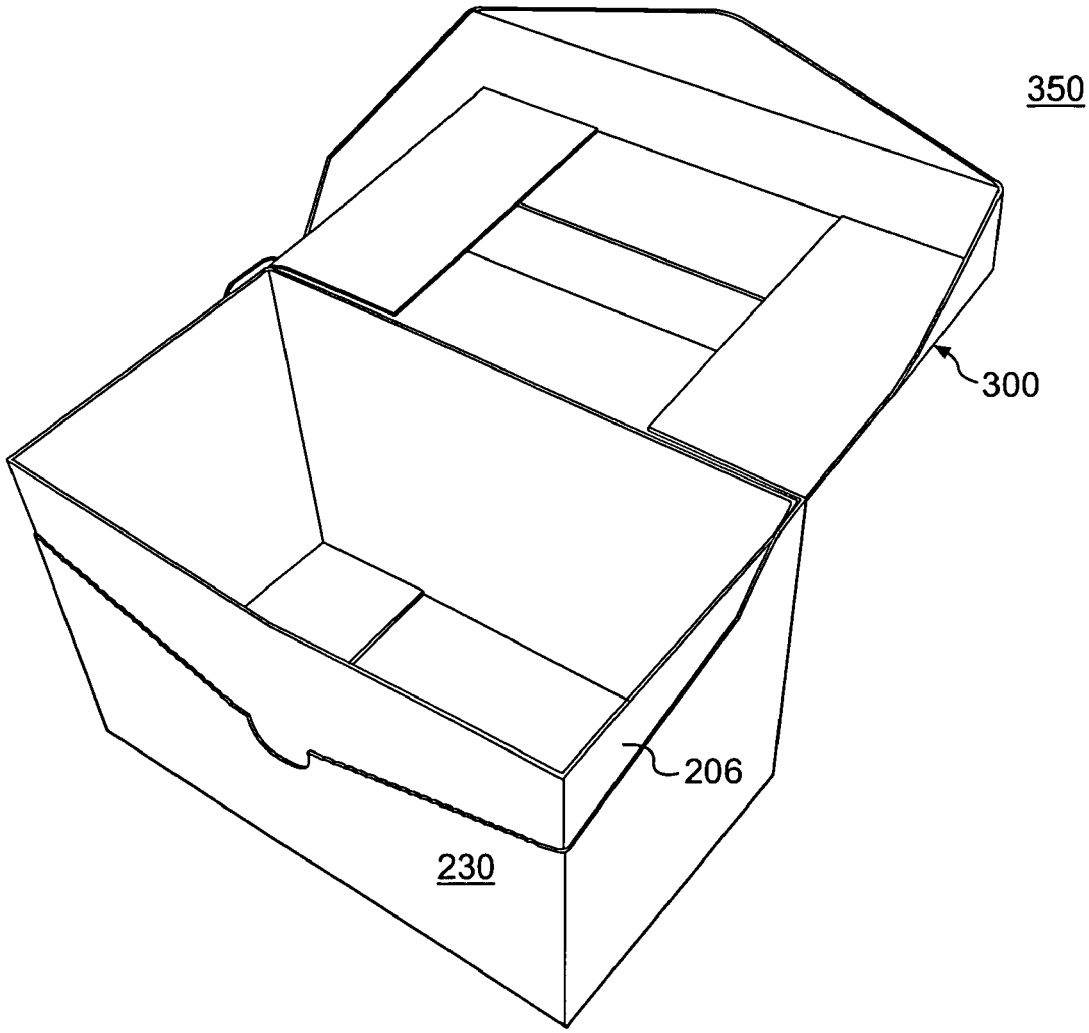
FIGS. 8A and 8B illustrate the second carton embodiment with a pivotable lid opened.
Figure 8B:
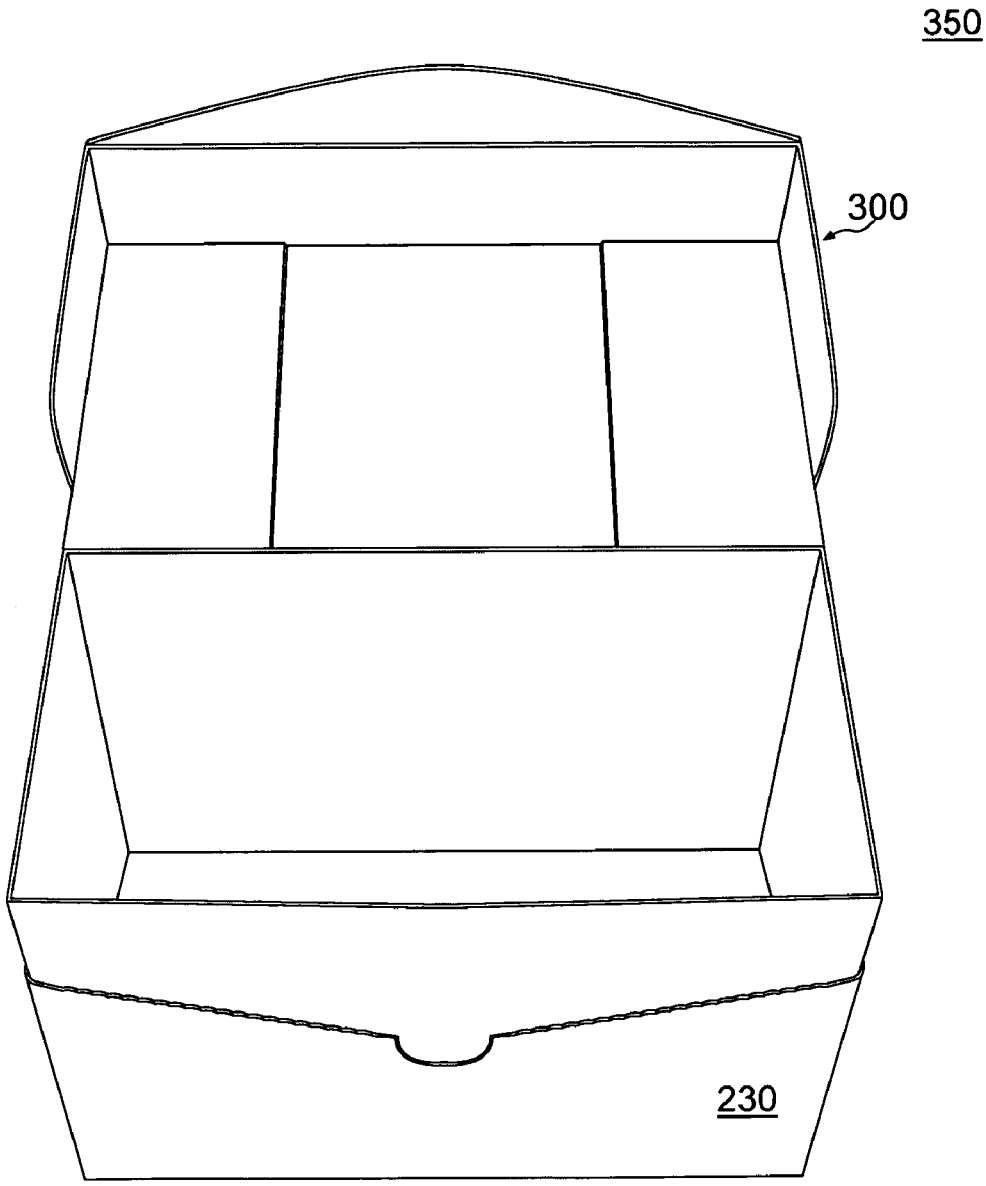

FIGS. 8A and 8B illustrate the carton 350 with the pivotable lid 300 opened. Referring also to FIG. 7B, the lid 300 may be opened by accessing the bottom flap 301 of the lid 300 at the cutout 304, and tearing along the cut or perforation 302 in the outer blank 205. The lid 300 can then be pivoted open. The inner blank 206 may remain intact and provides an inner shell or sleeve in the interior of the carton 350. The lid 300 can be reclosed and friction between the lid 300 and the inner blank 206 can retain the lid 300 in a closed position. The inner blank 206 provides reinforcement for the carton 350 that greatly increases the strength of the carton under axial compression.

Figure 9:
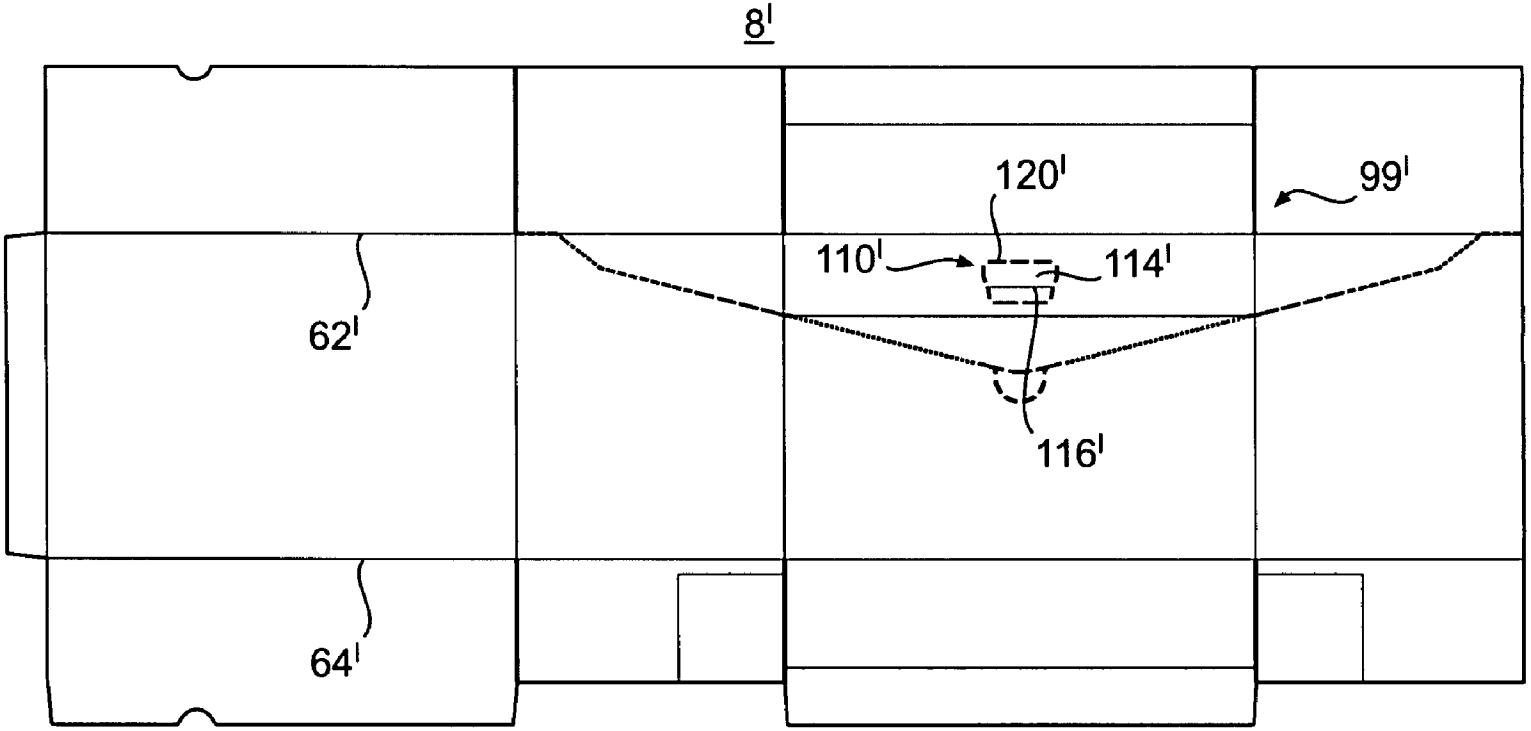
FIG. 9 is a plan view of a blank used to form a carton according to a third embodiment of the invention.

FIG. 9 is a plan view of multi-ply blank $\mathbf{8}^{I}$ used to form a carton according to a third embodiment of the invention. The blank $\mathbf{8}^{I}$ is formed from an outer blank $\mathbf{5}^{I}$ and an inner blank $\mathbf{6}^{I}$ adhered, laminated or otherwise joined to the outer blank $\mathbf{5}^{I}$. The inner blank $\mathbf{6}^{I}$ may be adhered to the outer blank $\mathbf{5}^{I}$ in the sections of the blank $\mathbf{5}^{I}$ between the fold lines $\mathbf{62}^{I}$, $\mathbf{64}^{I}$, and outside of the lid pattern $\mathbf{99}^{I}$. The blank $\mathbf{8}^{I}$ is generally similar to the blank 8 illustrated in FIG. 2, with elements of the blank $8^{I}$ indicated by a superscript "I." The blank $8^{I}$ has a click-shut latch $110^{I}$ of a different shape than the click-shut latch 110 in the blank 8. The blank $8^{I}$ can be erected into a carton in a manner similar to the blank 8.

Figure 10A:
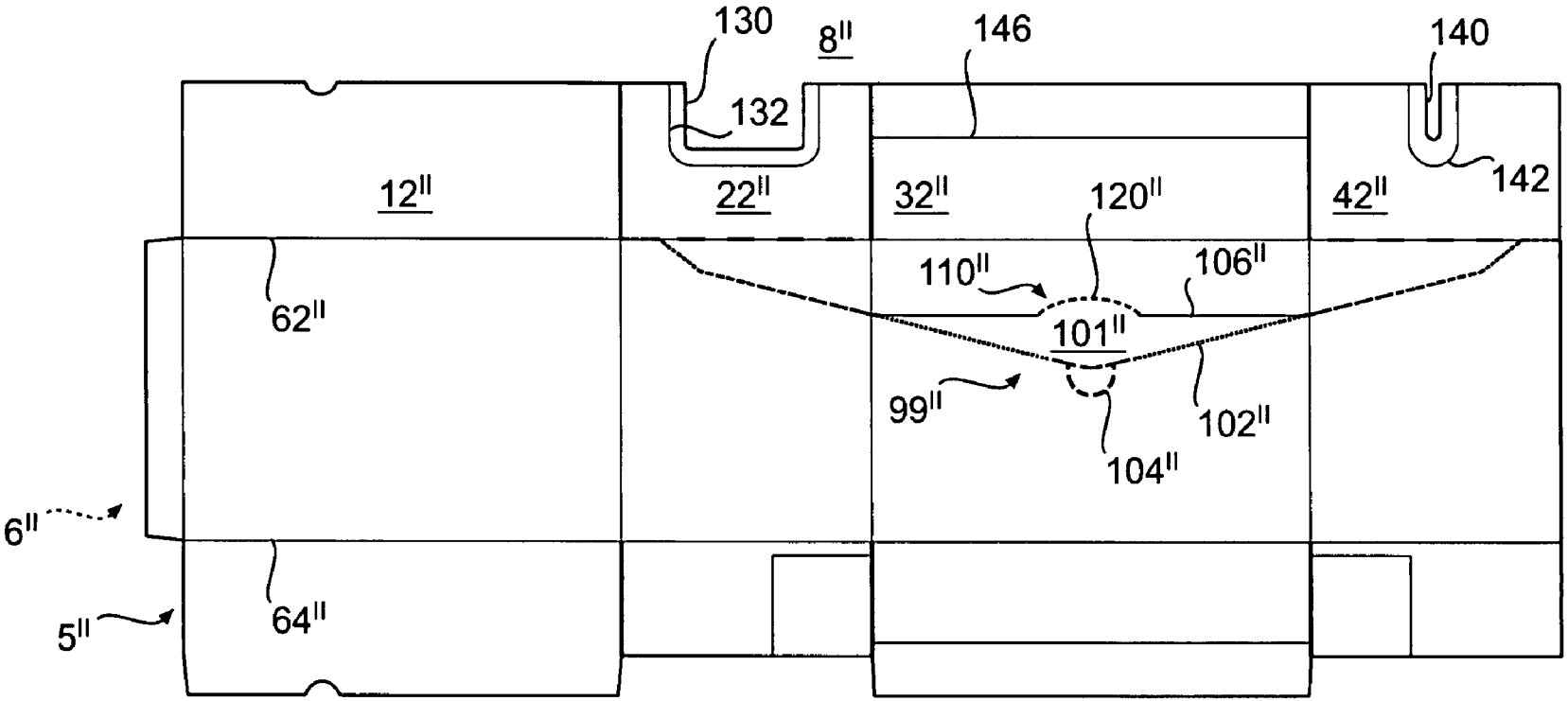
FIG. 10A is a plan view of a blank used to form a carton according to a fourth embodiment of the invention.

FIG. 10A is a plan view of multi-ply blank $8^{II}$ used to form a carton $150^{II}$ (illustrated in FIG. 10B) according to a fourth embodiment of the invention. The blank $8^{II}$ is formed from an outer blank $5^{II}$ and an inner blank $6^{II}$ adhered, laminated or otherwise joined to the outer blank $5^{II}$. The inner blank $6^{II}$ may be adhered to the outer blank $5^{II}$ in the sections of the blank $5^{II}$ between the fold lines $62^{II}$, $64^{II}$, and outside of the lid pattern $99^{II}$. The blank $8^{II}$ is generally similar to the blank 8 illustrated in FIG. 2, with elements of the blank $8^{II}$ indicated by a superscript "II." The blank $8^{II}$ has a click-shut latch $110^{II}$ of a different shape than the click-shut latch 110 in the blank 8. The blank $8^{II}$ also includes cutouts 130, 140 and scores 132, 142 in the outer blank $5^{II}$, that can be used to accommodate an article in the erected carton $150^{II}$, as discussed in further detail below. The blank $8^{II}$ can be erected into a carton in a manner similar to the blank 8. The outer blank $5^{II}$ includes a cut or perforation $120^{II}$ that defines a locking projection 162 in the carton $150^{II}$. The locking projection 162 is sized to engage a locking aperture 160 in the inner blank $6^{II}$ (FIG. 10B).

Figure 10B:
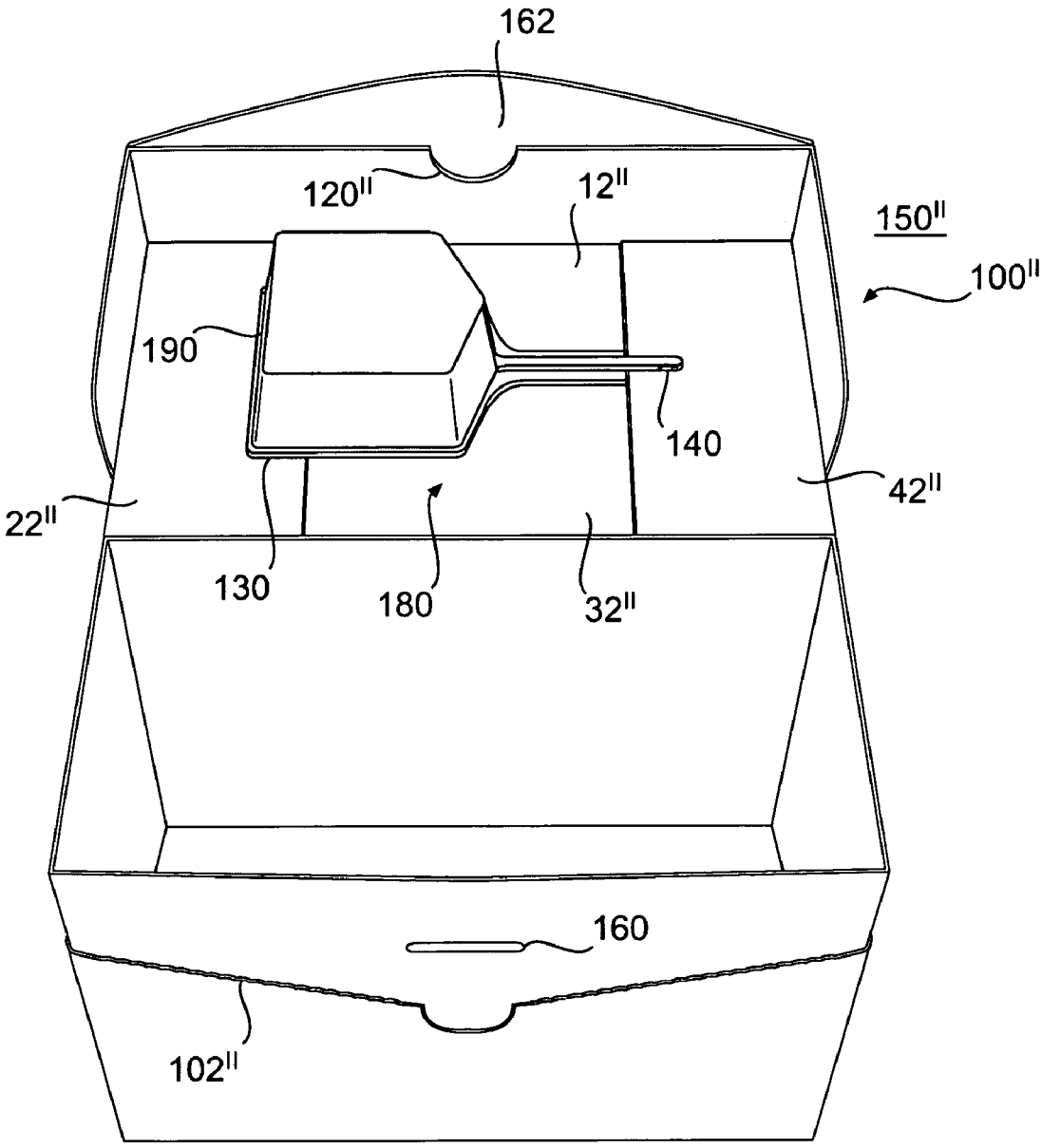
FIG. 10B illustrates the fourth carton embodiment.

FIG. 10B illustrates the carton $150^{II}$ with a lid $100^{II}$ of the carton opened. The lid $100^{II}$ may be opened by tearing the outer blank $5^{II}$ along the breachable bottom line $102^{II}$. The lid $100^{II}$ can be secured in a closed position by engaging the locking projection 162 in the locking aperture 160.

The carton $150^{II}$ includes a receiving aperture 180 defined in the pivotable lid $100^{II}$ by the cutouts 130, 140 and the scores 132, 142. The receiving aperture 180 can be constructed and arranged, for example, to receive an article 190 that is complementary to product accommodated in the bottom receptacle of the carton $150^{II}$. For example, if detergent is accommodated in the carton $150^{II}$, the receiving aperture 180 can be designed to accommodate a scoop or other metering device designed to measure out the detergent. The article 190 can be mounted in the receiving aperture 180 during erection of the carton. In FIG. 10B, the article 190 is a soap scoop mounted in the aperture between the side end flaps $22^{II}$, $42^{II}$, and the flaps $12^{II}$, $32^{II}$. A cup portion of the scoop 190 can have a flange that supports the scoop 190 in the cutout 130, and a handle section can be received in the cutout 140. The flange of the scoop 190 is held in place by the upper surfaces of the flaps $22^{II}$, $42^{II}$. The upper surfaces of the flaps $22^{II}$, $42^{II}$ in the vicinity of the flange are therefore free of adhesives so the scoop 190 can be fitted into the cutouts 130, 140. The article 190 can be mounted in the lid $100^{II}$ during erection of the carton, for example.

Figure 11:
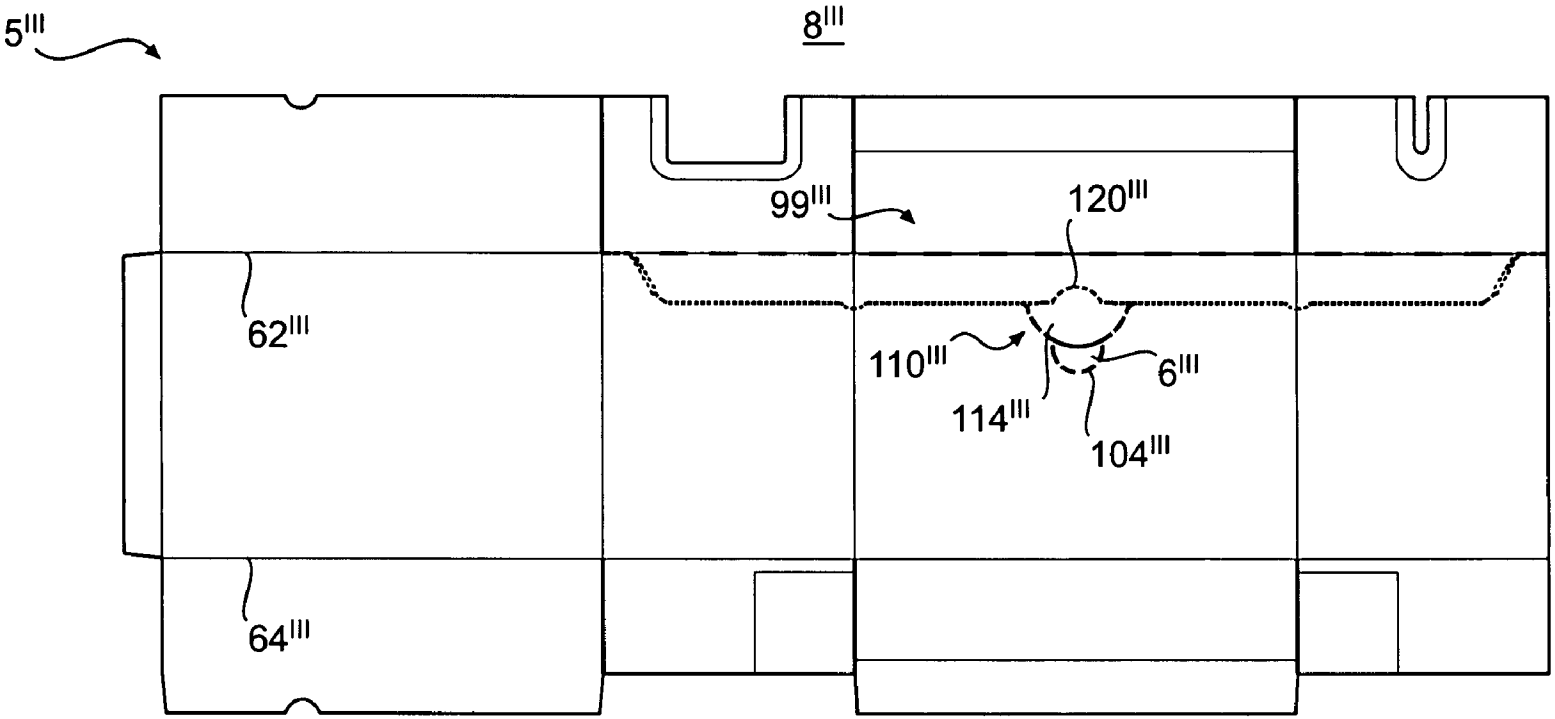
FIG. 11 is a plan view of a blank used to form a carton according to a fifth embodiment of the invention.

FIG. 11 is a plan view of multi-ply blank $8^{III}$ used to form a carton according to a fifth embodiment of the invention. The blank $8^{III}$ is formed from an outer blank $5^{III}$ and an inner blank $6^{III}$ adhered, laminated or otherwise joined to the outer blank $5^{III}$. The inner blank $6^{III}$ may be adhered to the outer blank $5^{III}$ in the sections of the blank $5^{III}$ between the fold lines $62^{III}$, $64^{III}$, and outside of the lid pattern $99^{III}$. The blank $8^{III}$ is generally similar to the blank $8^{II}$ illustrated in FIG. 10A, with elements of the blank $8^{III}$ indicated by a superscript "III." The blank $8^{III}$ has a click-shut latch $110^{III}$ of a slightly different shape than the click-shut latch 110 in the blank 8, and the lid pattern $99^{III}$ is of slightly different configuration. The blank $8^{III}$ can be erected into a carton in a manner similar to the blank $8^{II}$.

Figure 12A:
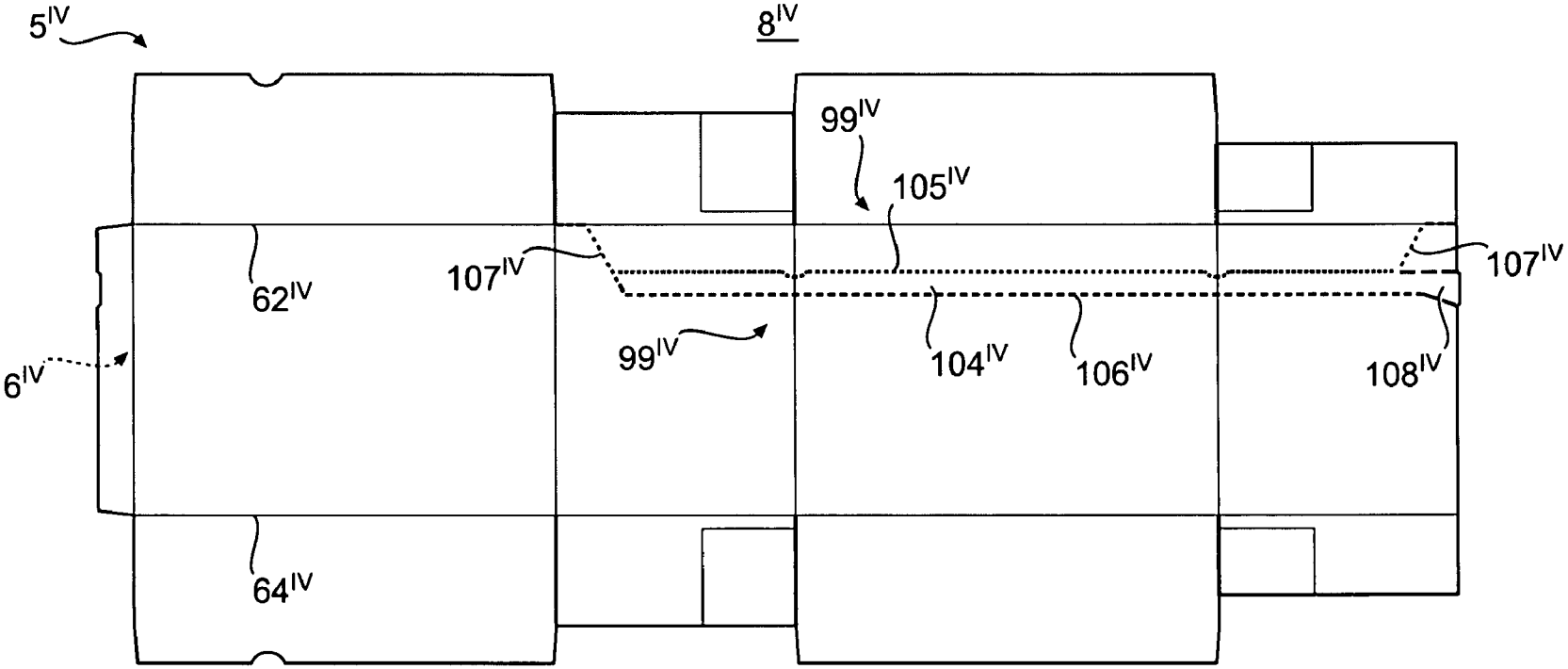
FIG. 12A is a plan view of a blank used to form a carton according to a sixth embodiment of the invention.
Figure 12B:
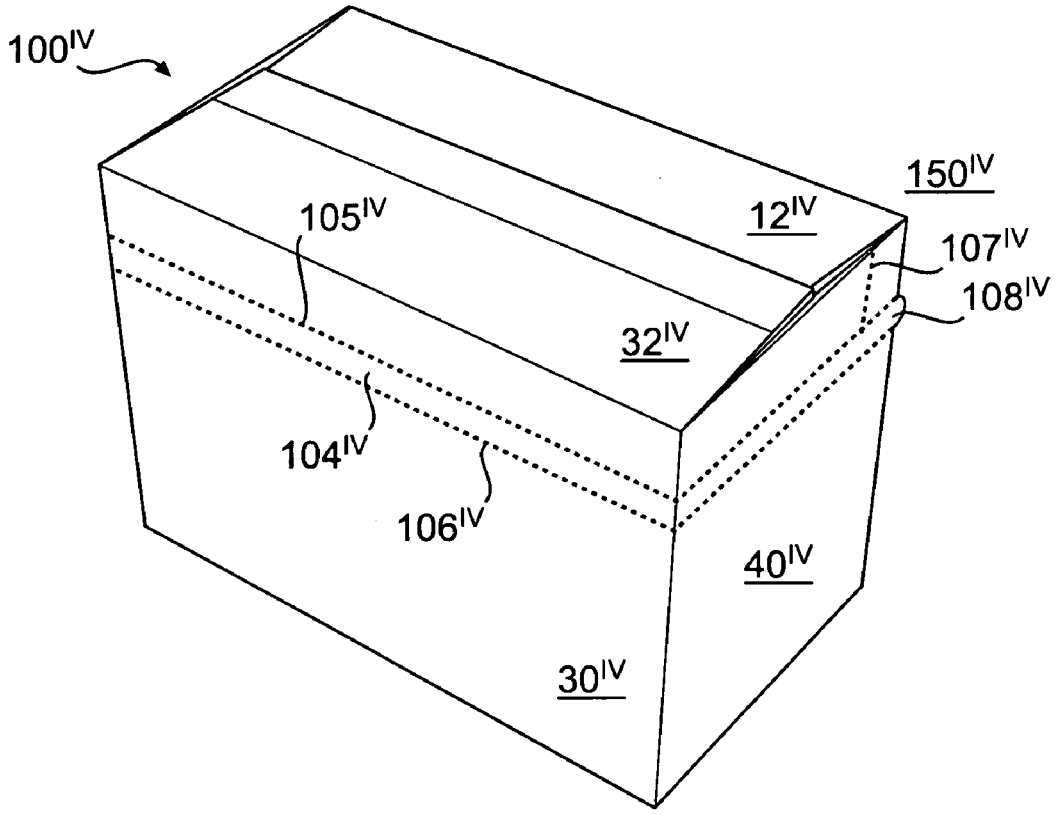
FIG. 12B illustrates the sixth carton embodiment.

FIG. 12A is a plan view of multi-ply blank $8^{IV}$ used to form a carton $150^{IV}$ according to a sixth embodiment of the invention. The blank $8^{IV}$ is formed from an outer blank $5^{IV}$ and an inner blank $6^{IV}$ adhered, laminated or otherwise joined to the outer blank $5^{IV}$. The inner blank $6^{IV}$ may be adhered to the outer blank $5^{IV}$ in the sections of the outer blank $5^{IV}$ between the fold lines $62^{IV}$, $64^{IV}$, and outside of the lid pattern $99^{IV}$. The blank $8^{IV}$ is generally similar to the blank 8 illustrated in FIG. 2, with elements of the blank $8^{IV}$ indicated by a superscript "IV." The blank $8^{IV}$ includes a lid pattern $99^{IV}$ with a tear strip $104^{IV}$ defined by spaced breachable lines of disruption $104^{IV}$, $105^{IV}$. Oblique breachable lines $107^{IV}$ extend upwardly from each end of the tear strip $104^{IV}$. FIG. 12B illustrates the erected carton $150^{IV}$. The lid pattern $99^{IV}$ defines a pivotable lid $100^{IV}$ in the carton $150^{IV}$. The lid $100^{IV}$ is opened by removing the tear strip $104^{IV}$ and breaching the outer blank 5 at the tear lines $107^{IV}$. The blank $8^{IV}$ can be erected into a carton in a manner similar to the blank 8.

Figure 13:
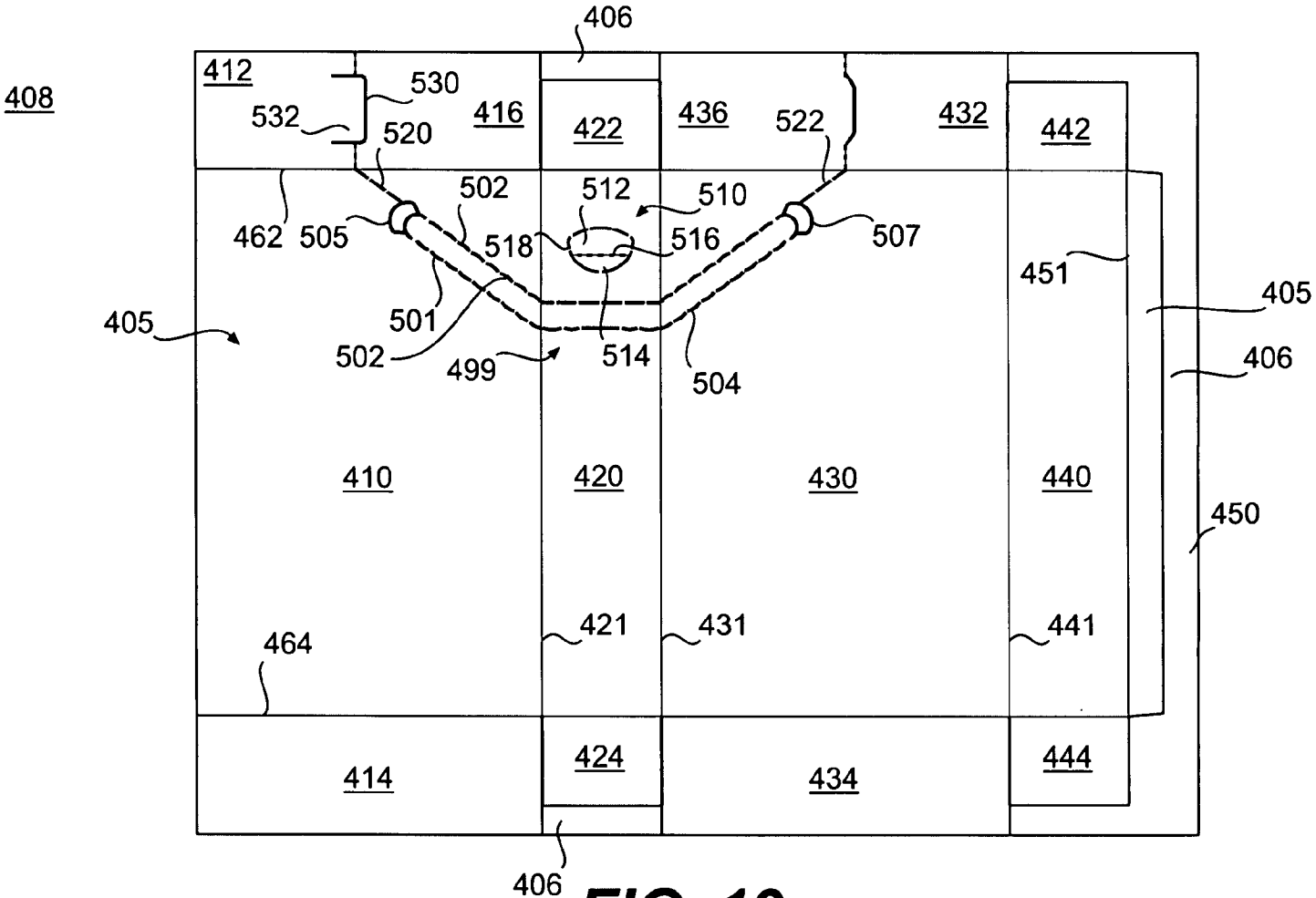
FIG. 13 is a plan view of a blank used to form a carton according to a seventh embodiment of the invention.

FIG. 13 is a plan view of two-ply blank 408 used to form a carton 550 (illustrated in FIG. 15A) according to a seventh embodiment of the invention. The blank 408 is formed from an outer blank 405 and an inner blank 406 adhered, laminated or otherwise joined to the outer blank 405. The outer surface or print surface of the outer blank 405 is visible in FIG. 13, and the inner blank 406 is joined to the opposite, underside of the outer blank 405. Therefore, only portions of the inner blank 406 are visible in FIG. 13. In general, the outer blank 405 may be formed from a continuous web such as the web A shown in FIG. 1, and the inner blank 406 may be formed from a continuous web B. The webs A and B undergo processing in the production line, including lamination together at station G, and separation into the final two-ply blank 408 at the third disruption station H.

The blank 408 comprises a first side panel 410 foldably connected to a first or exiting end panel 420 at a first transverse fold line 421, a second side panel 430 foldably connected to the first end panel 420 at a second transverse fold line 431, and a second end panel 440 foldably connected to the second side panel 430 at a third transverse fold line 441. An adhesive flap 405 can be foldably connected to the second side panel 440 at a transverse fold line 451, and may be partially or wholly formed from the outer blank 405. An adhesive flap 450 of the inner blank 406 extends from the right side of the blank 408.

The first side panel 410 is foldably connected to a first side top flap 412 and a first side bottom flap 414. The first end panel 420 is foldably connected to a first top end flap 422 and a first bottom end flap 424. The second side panel 430 is foldably connected to a second side top flap 432 and a second side bottom flap 434. The second end panel 440 is foldably connected to a second top end flap 442 and a second bottom end flap 444. When the carton 550 (FIG. 15A) is erected, the top flaps 412, 422, 432, 442 close a top of the carton 550, and the bottom flaps 414, 424, 434, 444 close a bottom of the carton 550. The top flaps 412, 422, 432, 442 extend along a first or top marginal area of the blank 408, and may be foldably connected at a first longitudinal fold line 462 that extends along the length of the blank 408. The bottom flaps 414, 424, 434, 444 extend along a second or bottom marginal area of the blank 408, and may be foldably connected at a second longitudinal fold line 464 that also extends along the length of the blank 408. The longitudinal fold lines 462, 464 may be straight fold lines, or may be offset at one or more locations to account for, for example, blank thickness or other factors.

The top flaps 412, 422, 432, 442 and the bottom flaps 414, 424, 434, 444 may be, for example, formed from the outer blank 405 (e.g. from the outer web A), and the portions of the inner blank 406 overlying the flaps 412, 422, 432, 442, 414, 424, 434, 444 may be free of or not adhered to the flaps. The portions of the inner blank 406 above and below the longitudinal fold lines 462, 464 may be designed so as to be foldable and sealable separate from the flaps 412, 422, 432, 442, 414, 424, 434, 444, as discussed in further detail below.

Figure 15A:
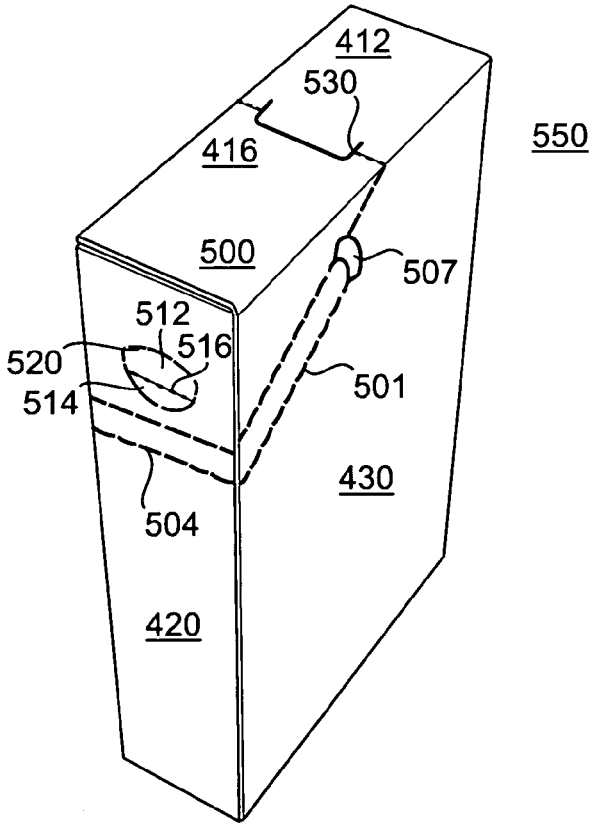
FIGS. 15A and 15B illustrate the seventh carton embodiment.

The outer blank 405 is provided with a lid pattern 499 that defines a pivotable lid or spout section 500 in the carton 550 (illustrated in FIG. 15A). The lid pattern 499 comprises breachable lines of disruption, such as cuts or perforations 501, 502 that extend across the panels 420, 430, 440 and that define a tear strip 504. The lid pattern 499 also includes breachable lines of disruption 520, 522 extending up the first and second side panels 410, 430 into the top flaps 412, 432. A click-shut latch 510 is formed in the outer blank 405, and has an outer perimeter defined by a cut or breachable perforation 518. A base portion 512 of the latch 510 is connected to a latch tab or flap 514 at a fold line 516. The area of the outer blank 405 within the lid pattern 499 is generally not adhered to the inner blank 406, except at the base 512 of the latch 510. The inner and outer blanks 405, 406 can otherwise be adhered together either continuously or selectively between the fold lines 462, 464. The first side top flap 416 can include a cut or perforation 530 defining a pivot flap 532.

Figure 14A:
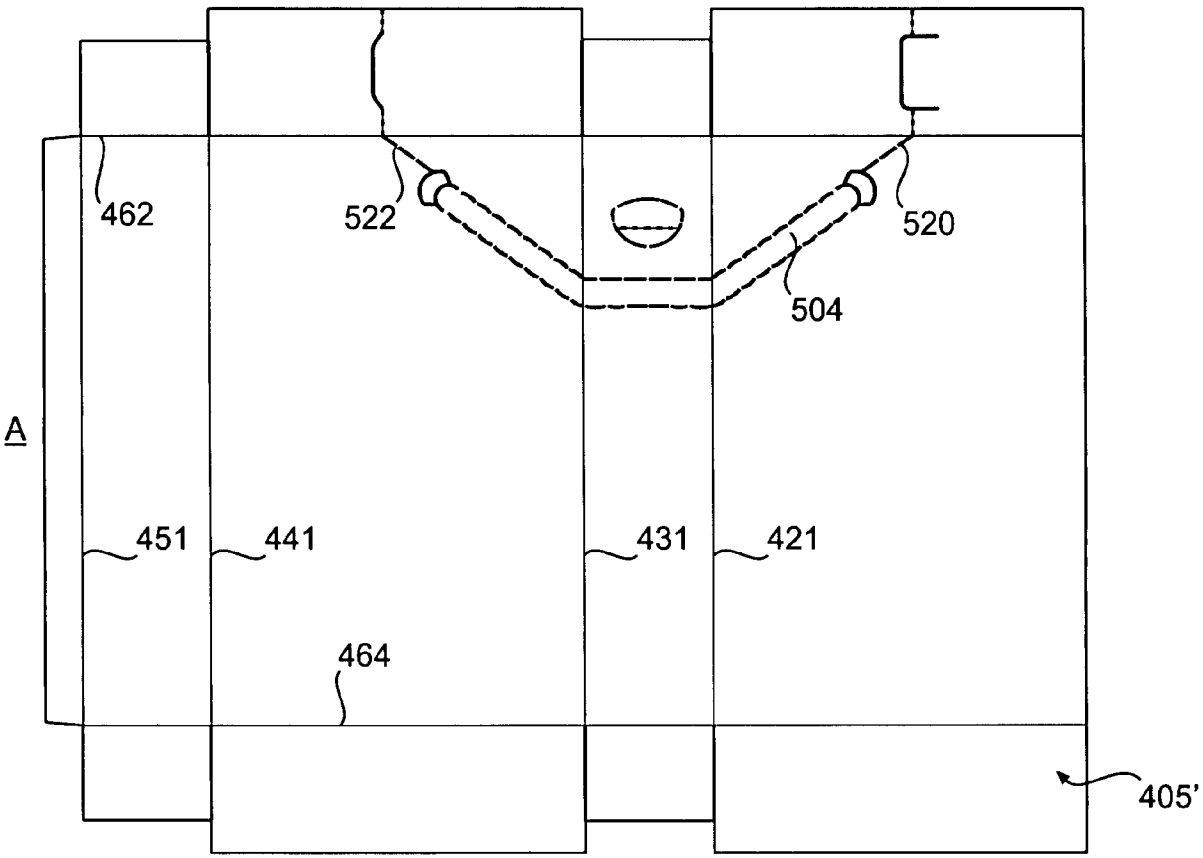
FIGS. 14A-14D illustrate blank formation and erection of the seventh carton embodiment.
Figure 14B:
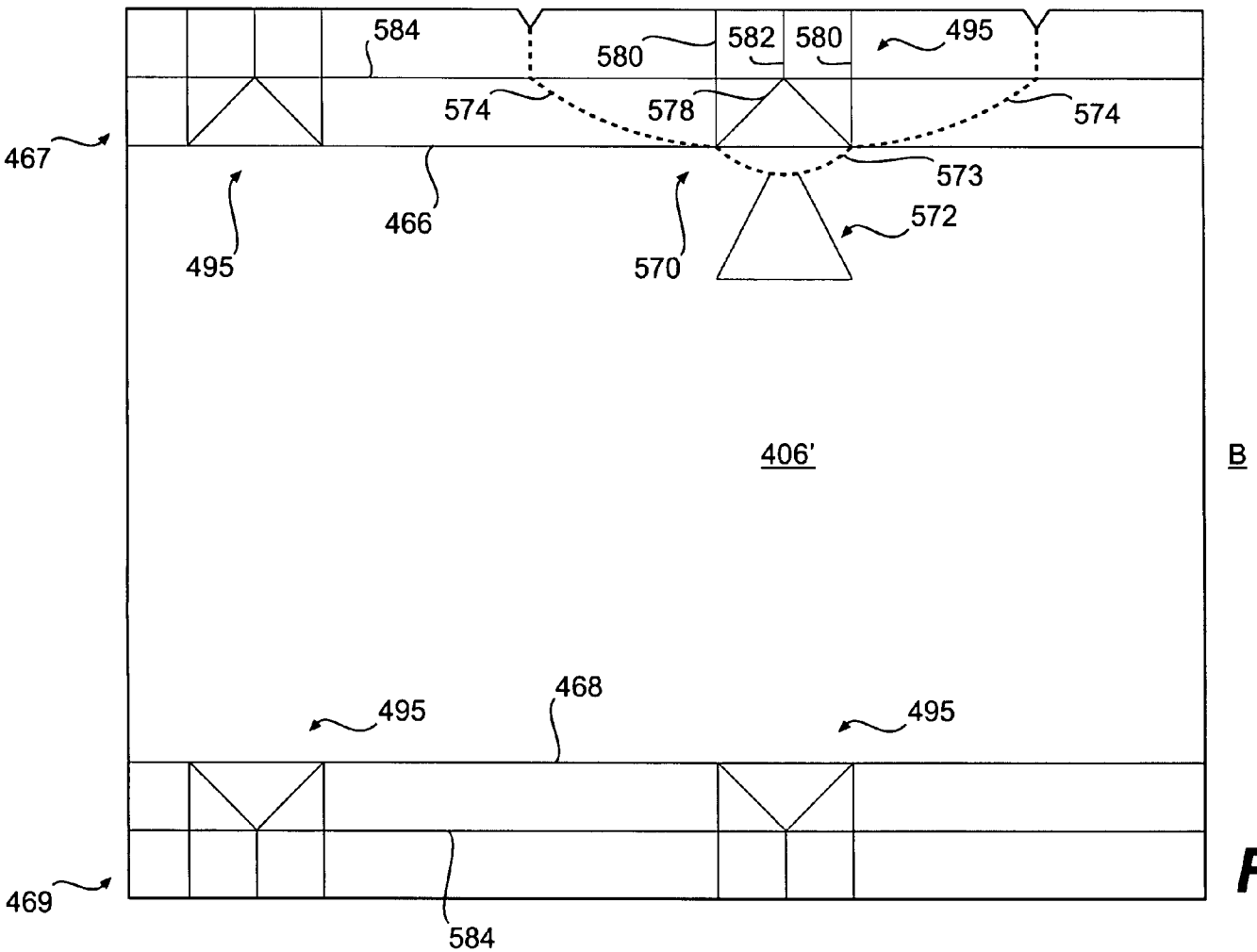

FIGS. 14A-14D illustrate an exemplary method of blank formation and erection of the carton 550. FIG. 14A is a plan view of the inner or interior surface of a partially completed section 405' of the continuous outer web A during formation of one of a continuous series of outer blanks 405, before the outer blank sections 405' are joined to corresponding inner blank sections 406' (FIG. 14B). In FIG. 14A, the web A is continuous and the vertical line at the far left of the section 405' and the vertical line at the far right of the section will not be formed until station H. The vertical lines are included merely to illustrate conceptual right and left boundaries of the section 405'. The lines of disruption formed in the web A in FIG. 14A may take place, for example, at the disrupting station F shown in FIG. 1, and the partially completed outer blank 405 is therefore indicated by the reference number 405'. The inner blanks will overlie the inner surface of the outer web A in the completed two-ply blank 408. As shown in FIG. 14A, substantially all of the lines of disruption formed in the outer blank sections 405' may be performed at the station F. If desired, certain lines of disruption can be formed further downstream in the process, simultaneously in the inner and outer blank sections. For example, one or more of the fold lines 421, 431, 441, 451 can be formed at the station H.

FIG. 14B is a plan view of the continuous inner web B during formation of one of a continuous series of inner blanks 406. The lines of disruption formed in the web B in FIG. 14B may take place, for example, at the disrupting station E shown in FIG. 1, and the partially completed inner blank 406 is indicated by the reference number 406'. In FIG. 14B, the web B is continuous and the vertical lines at the far left and right of the section 406' are included merely to illustrate the right and left boundaries of the section 406'. In FIG. 14B, the partially completed inner blank 406' is provided with a tear-away pattern 570 that allows a portion of the finished inner blank 406 to be removed upon opening of the carton 550. The tear-away pattern 570 includes a generally trapezoidal directional pour spout section 572, a curved center tear line section 573, side tear line sections 574, and a gable score section 495. The gable score section 495 includes a triangular score portion 578, and transverse scores 580, 582. A longitudinal score line 584 extends across the top portion of the blank 406', through the gable score section 495. Additional gable scores 495 are provided in upper and lower marginal areas 467, 469 of the partially completed inner blank 406' to allow the final inner blank 406 to be folded inwardly during erection of the carton 550.

Figure 14C:
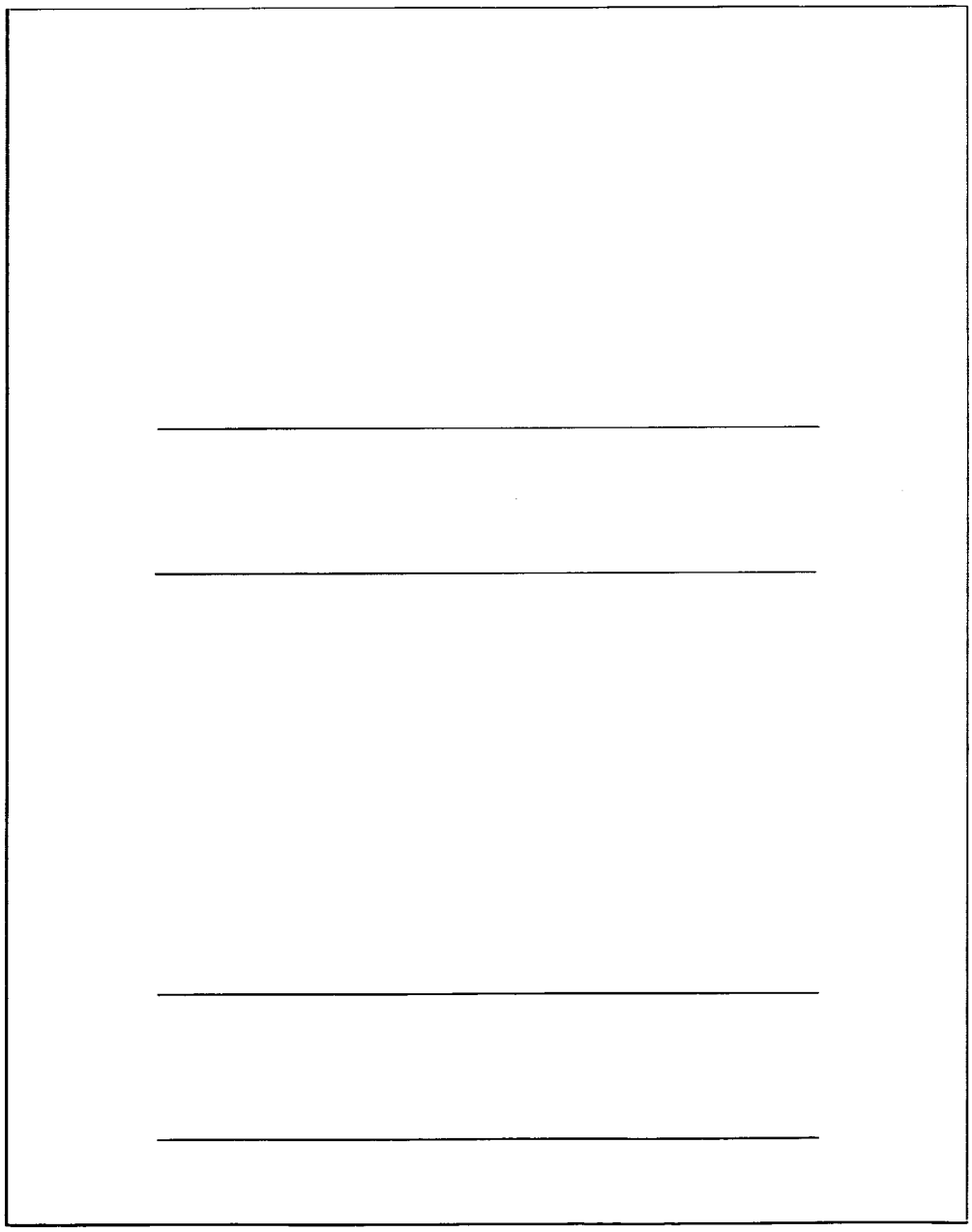

FIG. 14C generally illustrates the final cuts at the final disrupting station H. The final cuts can be used to form, for example, the fold lines 421, 431, 441, 451. The cuts can extend through both webs A and B, for example, so that the fold lines are formed in a single operation. After exiting the station H, the webs A and B are cut into individual blanks 408. The border in FIG. 14C is provided for reference to indicate the general footprint of a finished blank 408.

Referring to FIG. 13, the blank 408 is erected into the carton 550 by adhering the exterior side of the flap 450 on the inner blank 406 to the interior side of the two-ply side panel 410, and adhering the exterior side of the flap 405 to the interior side of the side panel 410. The blank 408 can now be opened up into a generally tubular form. Referring also to FIG. 14B, the bottom end of the tubular form is closed by folding in the bottom marginal area 469 of the inner blank 406 below the fold line 469. The panels defined in the bottom marginal area and the gable score sections 495 can be adhered together to form a relatively tight seal. The flaps 424, 444 of the outer blank 405 are then folded inwardly and the flaps 414, 434 of the blank 405 are folded over and adhered to the flaps 424, 444 to close the bottom of the tubular form.

Figure 14D:
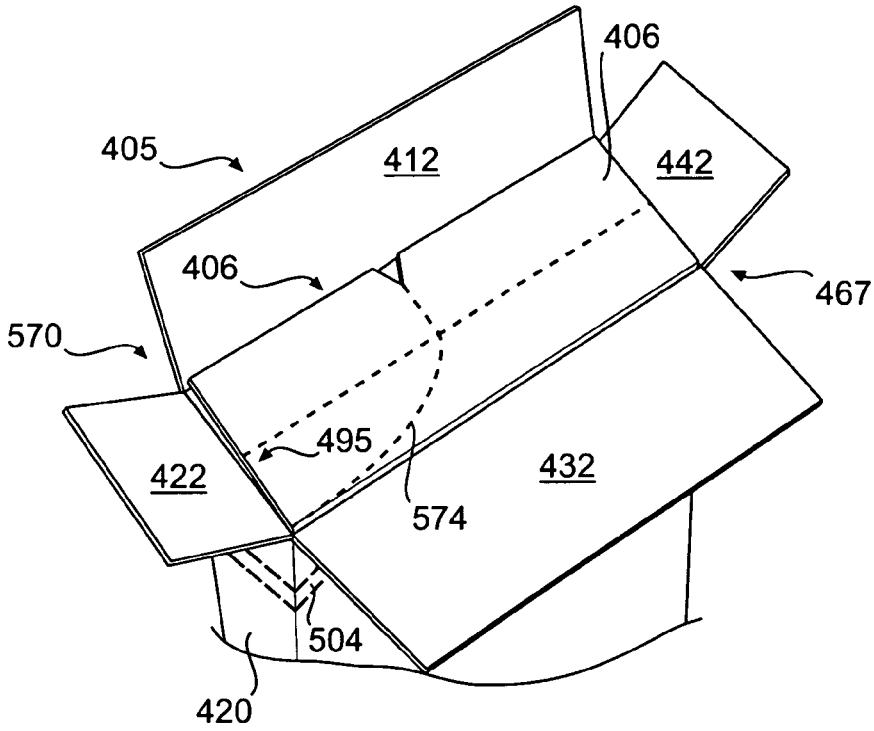

Referring to FIG. 14D, the top of the tubular form is closed by folding the top marginal area 467 of the inner blank 406 over and adhering the panels defined in the top marginal area 467 and the gable sections 495 together. One of the side tear line sections 574 is visible at the open top of the carton. The generally trapezoidal direction pour spout section 572 is disposed behind the first, exiting end panel 420 and the base section 512 of the outer blank 405 is adhered to the spout section 572. The top flaps 422, 442 are then folded inwardly over the folded and glued top marginal area 467 of the inner blank 406, the flap 432 is folded over the flaps 422, 442, and the flap 412 is folded over the flaps 432, 422, 442 and adhered thereto. The gable sections 495 are illustrated as folded inwardly in FIG. 14D. The gable sections 495 may alternatively be folded out and tucked under the flaps 412, 422, 432, 442.

Figure 15B:
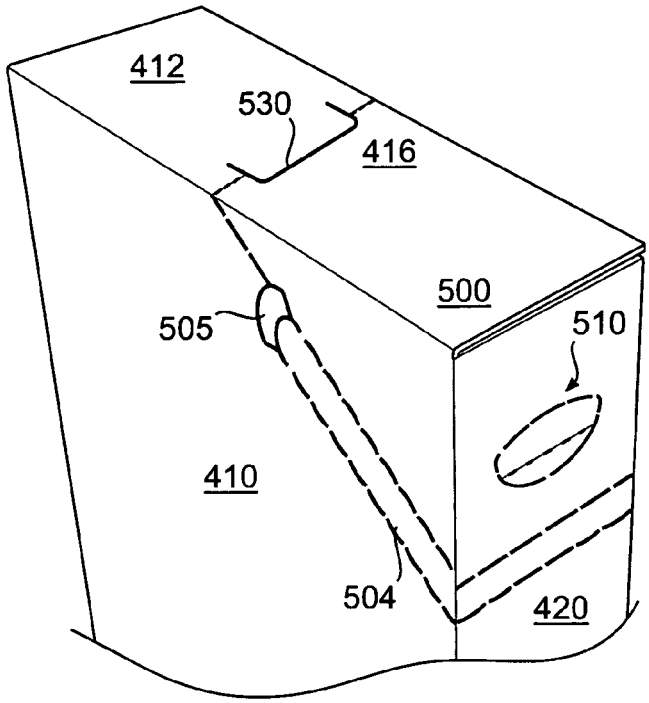

FIGS. 15A and 15B illustrate the carton 550 erected from the blank 8. Product, such as particulate detergents, discrete articles, or other items, may be packed into the carton 550 at any time before closing the top and bottom ends of the carton. The carton 550 is generally parallelepipedal in shape. The lid pattern 499 defines a pivotable lid 500 in the carton 550 that when opened, allows dispensing of product from the carton 550. The tear strip 504 extends across the end panel 420 and both side panels 410, 430 of the carton 550.

Figure 16A:
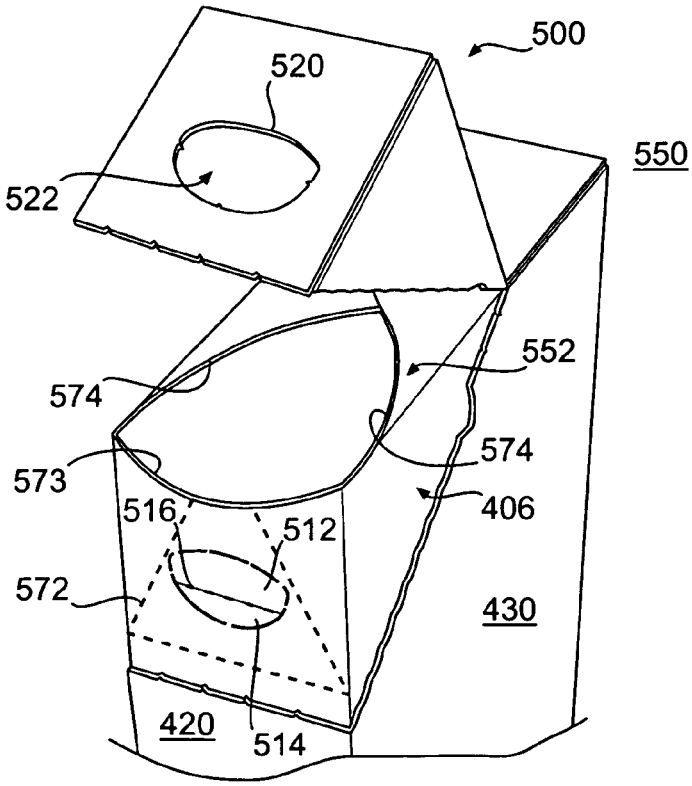
FIGS. 16A and 16B illustrate opening and closing of a corner spout of the seventh carton embodiment.
Figure 16B:
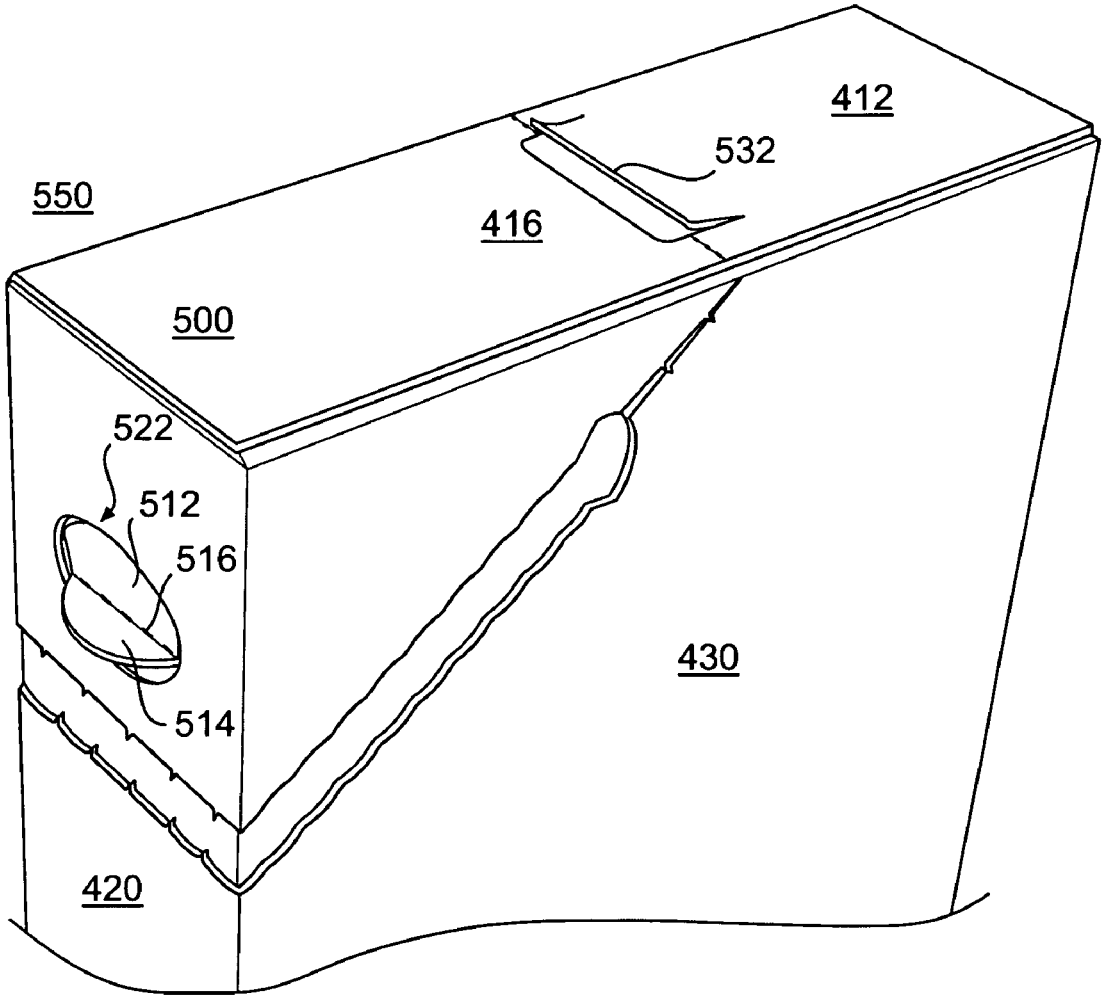

FIGS. 16A and 16B illustrate opening and closing of the pivotable lid 500 of the carton 550. Referring to FIG. 16A, the lid 500 may be opened by removing the tear strip 504. The tear strip 504 can be accessed, for example, at either of the cutouts 505, 507. The lid 500 can then be pivoted open. The base 512 of the latch 510 is adhered, laminated or otherwise joined to the inner blank 406 and separates from the remainder of the lid 500, which creates a latch opening 522 in the lid 500 from the perimeter line 520. The inner blank 406 may remain substantially intact during opening of the lid 500, and lines the inner surface of the outer blank 405. The inner blank 406 is then torn open at the tear-away pattern 570 to create a spout dispenser opening 552 through which product in the carton 550 can be dispensed. If desired, the inner blank 406 can be pinched or otherwise deformed outwardly at the directional spout pattern 572 to narrow the dispenser opening 552.

Referring to FIG. 16B, the lid 500 may be reclosed by bending the latch tab 514 upwardly at the fold line 516, and pivoting the lid 500 downwardly until the latch tab 514 engages the latch opening 522. According to the above embodiment, the latch tab 514 can emit an audible noise, such as a 'click,' when the tab 514 is engaged and/or disengaged with the latch opening 522. Opening of the lid 500 may be sufficient to bend the latch tab 514 to its latching position, so bending the latch tab 514 may be unnecessary. The pivot flap 532 (shown in FIG. 15A) may help to maintain the lid 500 in an open position. If desired, the latch mechanism in the carton 550 can be omitted, and the lid 500 can be opened and closed without a locking action. Friction between the lid 500 and the inner blank 406, for example, may be sufficient to retain the lid in a closed position.

Figure 17:
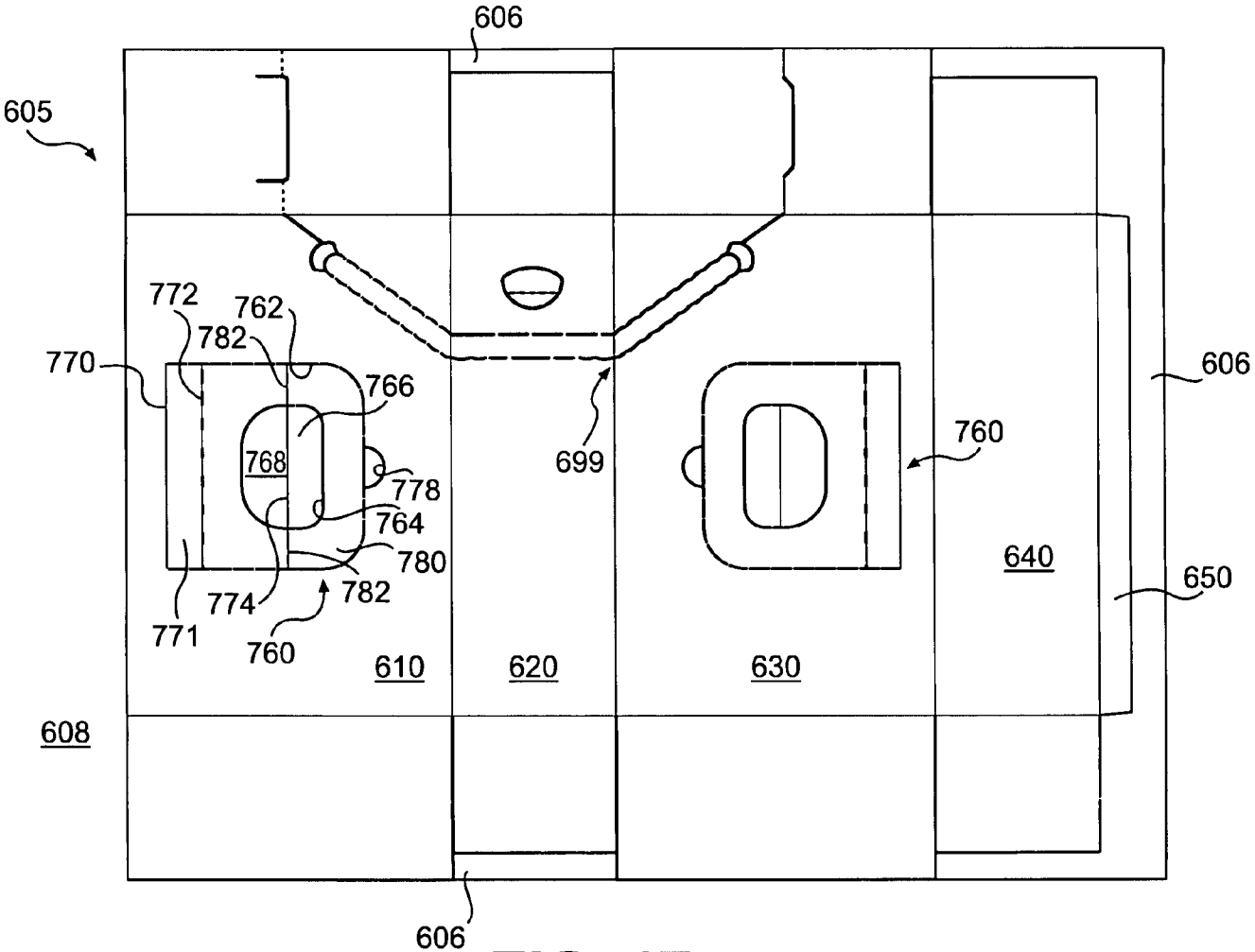
FIG. 17 is a plan view of a blank used to form a carton according to an eighth embodiment of the invention.

FIG. 17 is a plan view of two-ply blank 608 used to form a carton 750 (illustrated in FIG. 18) according to an eighth embodiment of the invention. The blank 608 is formed from an outer blank 605 and an inner blank 606 adhered, laminated or otherwise joined to the outer blank 605. The outer surface or print surface of the outer blank 605 is visible in FIG. 17, and the inner blank 606 is joined to the underside of the outer blank 605. Therefore, only portions of the inner blank 606 are visible in FIG. 17. The blank 608 is generally similar to the blank 408 illustrated in FIG. 13, with the blank 608 including first and second carrying handles 760 not present in the blank 408. The outer blank 605 can be substantially identical to the outer blank 405, except for the handles 760 formed in the blank 605. The inner blank 606 can be substantially identical or identical to the inner blank 406. Like reference numbers in FIG. 17, preceded by a "6" or "7", indicate like or identical elements to those present in FIG. 13. The blanks 605, 606 may be adhered together in the area of the panels 610, 620, 630, 640, outside of the handles 760 and outside of the lid pattern 699.

The two handles 760 may be formed in the outer blank 605, and may be mirror images of one another. The first or leftmost handle 760 is discussed in detail below. The handle 760 is defined at its outer perimeter by an outer breachable line of disruption such as a cut or perforation 762, and a fold line 770. A handle aperture pattern 764 defines a portion in the handle 760 in which a user can insert a hand. An access cutout 778 can be included to allow a user access to the handle 760. A fold line 772 extends spaced from and parallel to the fold line 770, with a vertical panel 771 defined therebetween. A transverse line 774 defines a flap 766 and a cutout 768 in the handle 760. A handle section 780 is defined between the perimeter line 762 and the aperture pattern 764. Fold lines 782 segment the handle section 780 into foldable sections.

Figure 18:
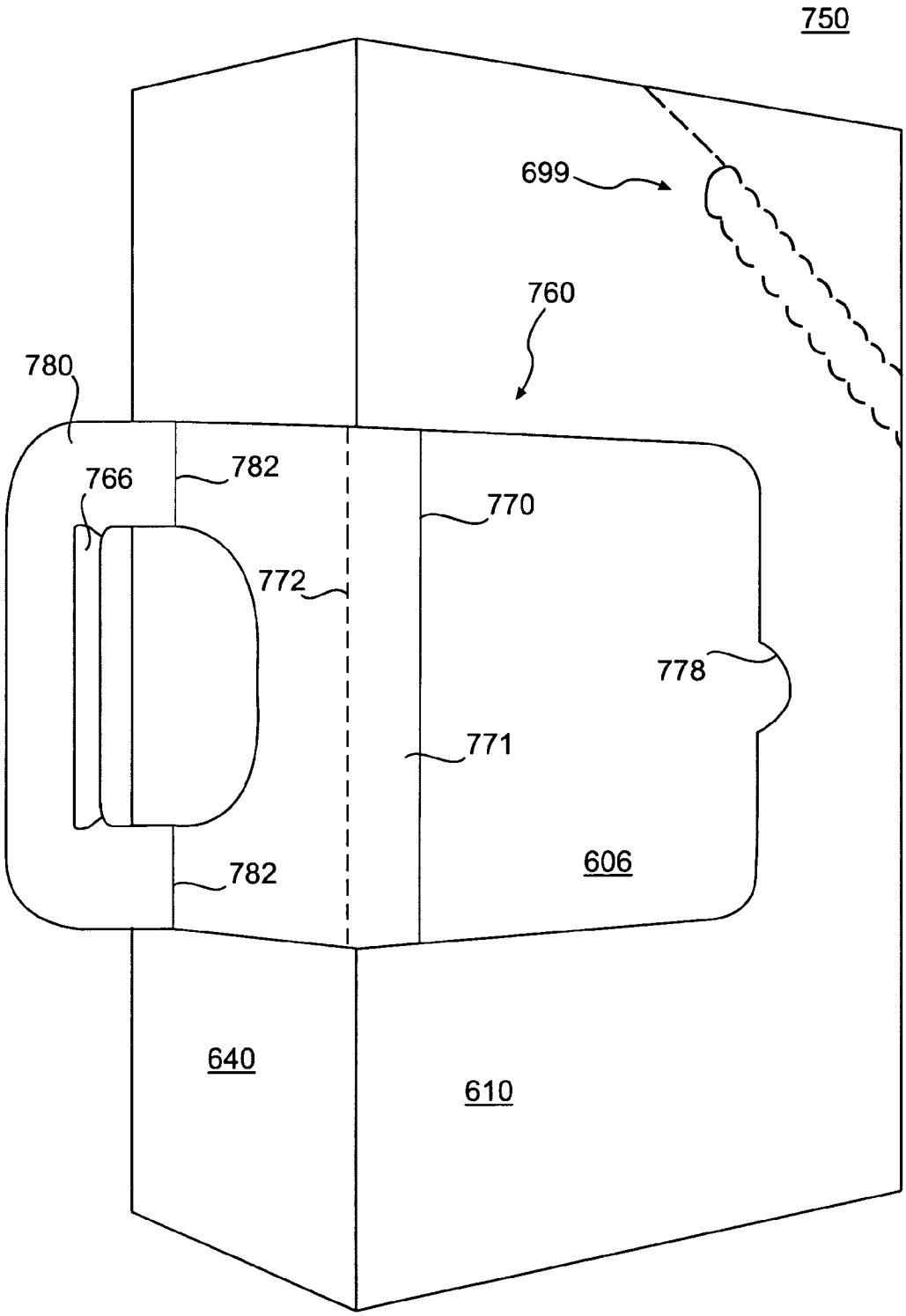
FIG. 18 illustrates the eighth carton embodiment.

FIG. 18 illustrates the carton 750 erected from the blank 608 with both handles 760 placed in a carrying configuration. A handle 760 is placed in its carrying configuration by accessing the handle 760 at the cutout 778 and pulling back on the handle section 780. This tears the outer blank 605 along the breachable perimeter 762. The handle 760 can be pulled back toward the panel 640 so that the handle 760 folds at the fold lines 770, 772, 782, as shown in FIG. 18. If desired, a flap 766 of one handle 760 may be folded into the other handle 760.

Figure 19:
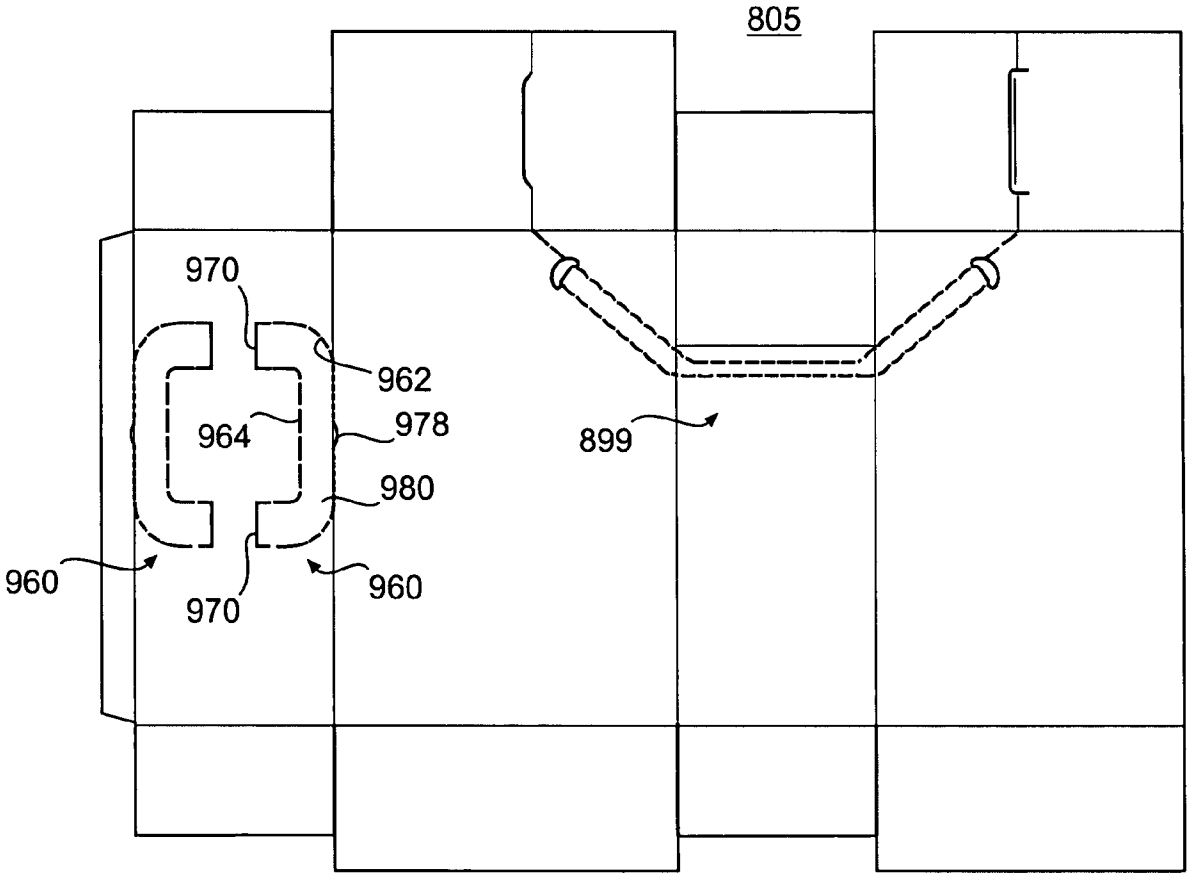
FIG. 19 is a plan view of a blank used to form a carton according to a ninth embodiment of the invention.

FIG. 19 is a plan view of an outer blank 805 used to form a carton 950 (illustrated in FIG. 20) according to a ninth embodiment of the invention. The blank 805 may be adhered, laminated or otherwise joined to the inner blank 606 discussed above. The outer blank 805 is generally similar to the outer blank 605 except for the differing arrangement and configuration of a pair of handles 960. Like reference numbers in FIG. 19, preceded by a "8" or "9" indicate like or identical elements to those present in FIG. 17. The blanks 805, 606 may be adhered together in areas of the blanks outside of the handles 960 and outside of the lid pattern 899.

The two handles 960 may be formed in the outer blank 805, and may be mirror images of one another. The first handle 960 is discussed in detail below. The handle 960 is defined at its outer perimeter by an outer perimeter breachable line of disruption 962, fold lines 770, and an inner perimeter breachable line of disruption 964. A U-shaped handle section 980 is defined by the perimeter lines 962, 964 and the fold lines 970. An access cutout 978 can be included to allow user access to the handle 960.

Figure 20:
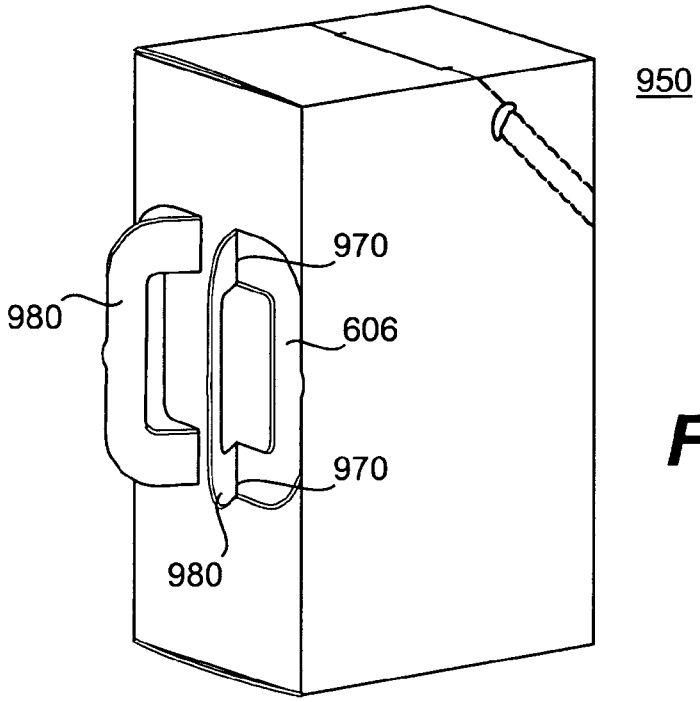
FIG. 20 illustrates the ninth carton embodiment.

FIG. 20 illustrates the carton 950 erected from the outer blank 805 and the inner blank 606 with both handles 960 placed in a carrying configuration. A handle 960 is placed in its carrying configuration by accessing the handle 960 at the cutout 978 and pulling back on the handle section 980. This tears the outer blank 805 along the lines 962, 964. The handles 960 can be pulled back so that they fold at the fold lines 970, as shown in FIG. 19.

Figure 21:
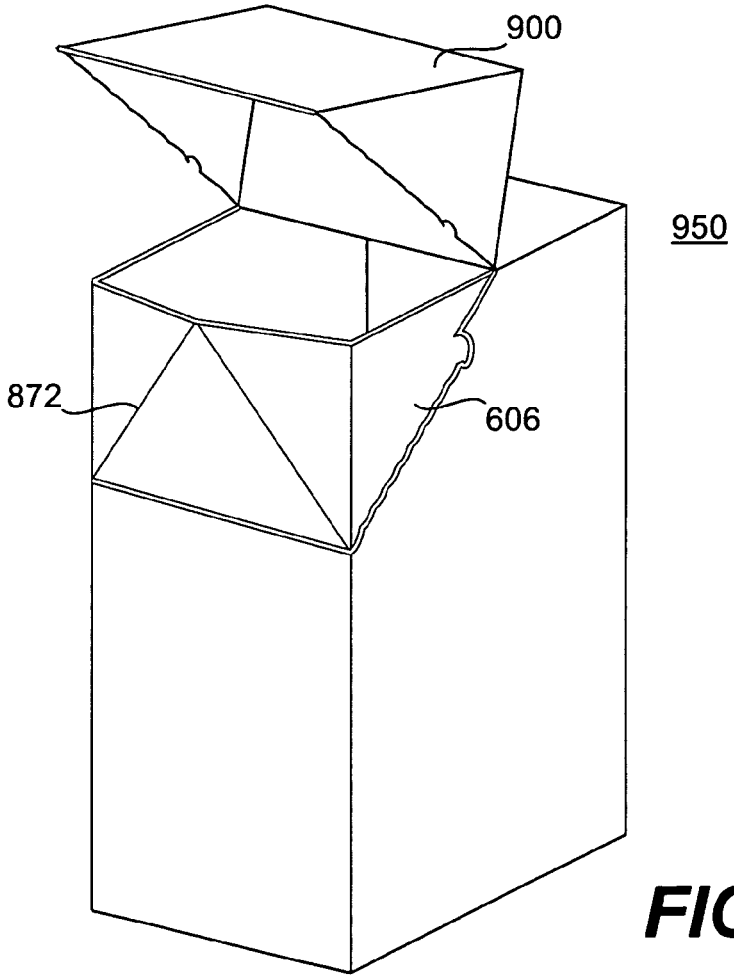
FIG. 21 illustrates an opened corner spout of the ninth carton embodiment.

The carton 950 includes pivotable lid 900 defined by the lid pattern 899 in the outer blank 805 (FIG. 19). FIG. 21 illustrates the pivotable lid 900 opened and the inner blank 606 deformed into a general V-shape at a directional pour spout pattern 872. An upper section of the blank 606 is opened so that product can be dispensed from the carton 950.

In accordance with the exemplary embodiments, the cartons may be constructed of paperboard, for example. The paperboard webs used to form the blank may be thicker and heavier than ordinary paper. The blanks, and thus the cartons, can also be constructed of other materials, such as cardboard, or any other material having properties suitable for enabling the carton to function at least generally as described above. For example, the blanks may be formed from coated solid unbleached sulfate (SUS) board. The blanks can also be laminated to or coated with one or more web-like materials at selected panels or panel sections.

One or more panels of the blanks discussed above can be coated with varnish, clay, or other materials, either alone or in combination. The coating may then be printed over with product, advertising, and other information or images. The blanks may also be coated to protect any information printed on the blank. The blanks may be coated with, for example, a moisture barrier layer, on either or both sides of the blanks.

In accordance with the exemplary embodiments, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or panels adhered together by glue. The term "glue" is intended to encompass all manner of adhesives commonly used to secure carton panels in place.

For purposes of the description presented herein, the term "line of disruption" can be used to generally refer to a cut line, a score line, a tear line, a crease line, perforations, or a fold line formed in blank material (or a combination of at least one cut line, score line, tear line, crease line, and/or fold line), or any form of disruption in a blank. A "breachable" line of disruption as disclosed in the specification refers to a line of disruption that is intended to be breached or otherwise torn during ordinary use of a carton.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A carton formed at least from an inner blank and an outer blank, comprising:

a multi-ply front panel formed from the inner blank and the outer blank;

a first end panel;

a back panel;

a second end panel;

a top panel; and a bottom panel, wherein a lid pattern is formed at least in the front panel, the lid pattern defining a latch and a pivotable lid, a base portion of the latch being formed in the outer blank and adhered to the inner blank wherein the latch is defined at least in partially by a perimeter line of disruption in the outer blank.

2. The carton of claim 1, wherein the pivotable lid comprises at least a portion of the front panel and the top panel.

3. The carton of claim 2, wherein the latch further comprises a latch tab connected to the base portion.

4. The carton of claim 2, wherein the first end panel, the back panel, and the second end panel are formed from the inner blank and the outer blank.

5. The carton of claim 4, wherein the bottom panel comprises a plurality of overlapped single-ply flaps.

6. A method of opening and reclosing a carton, comprising:

providing a carton according to claim 3;

tearing the outer blank along the lid pattern, wherein the base portion separates from the lid during the tearing and leaves a latch aperture in the lid;

pivoting the lid open;

pivoting the lid closed; and engaging the latch tab in the latch aperture.

7. The carton of claim 1 wherein the inner blank forms a sleeve within the outer blank.

8. The carton of claim 7, wherein the pivotable lid comprises at least a portion of the front panel and the top panel.

9. The carton of claim 8, wherein the lid comprises at least one front wall in the front panel formed from the outer blank, and wherein the front wall of the lid overlaps and is separable from the sleeve.

10. The carton of claim 9, wherein the lid pattern extends in the first and second end panels.

11. The carton of claim 10, wherein a majority of the at least one front wall is not adhered to the inner blank.

12. The carton of claim 9, wherein the bottom panel is formed from a plurality of overlapped single-ply flaps.

13. The carton of claim 9, wherein the lid pattern defines a tear strip in the outer blank, the tear strip defining a lower edge of the pivotable lid.

14. The carton of claim 7, wherein the top panel comprises an article receiving aperture, the carton further comprising an article mounted in the article receiving aperture.

15. A method of opening a carton, comprising:

providing a carton according to claim 9;

tearing the outer blank along the lid pattern; and pivoting the lid open.

16. A carton formed at least from an inner blank and an outer blank, comprising:

a multi-ply first end panel formed from the inner blank and the outer blank;

a first side panel;

a second end panel;

a second side panel;

a top panel; and a bottom panel, wherein a lid pattern is formed at least in the first end panel, the lid pattern defining a latch and a pivotable lid, a base portion of the latch being formed in the outer blank and adhered to the inner blank wherein the inner blank comprises a directional pour spout pattern adjacent to the pivotable lid.

17. The carton of claim 16, wherein the inner blank comprises a tear-away pattern that allows a portion of the inner blank adjacent to the pivotable lid to be removed from the inner blank.

18. The carton of claim 16, wherein the pivotable lid comprises at least a portion of the first side panel and the second side panel.

19. The carton of claim 18, wherein the latch is defined at least partially by a perimeter line of disruption in the outer blank.

20. The carton of claim 18, wherein the latch further comprises a latch tab connected to the base portion.

21. The carton of claim 18, wherein the first side panel, the second end panel, and the second side panel are formed from the inner blank and the outer blank.

22. The carton of claim 16, further comprising at least one handle formed from the outer blank, the at least one handle being movable away from the inner blank.

23. A method of opening and reclosing a carton, comprising:

providing a carton according to claim 16;

tearing the outer blank along the lid pattern, wherein the base portion separates from the lid during the tearing and leaves a latch aperture in the lid;

pivoting the lid open;

pivoting the lid closed; and engaging the latch in the latch aperture.

24. A carton formed at least from an inner blank and an outer blank, comprising:

a multi-ply first end panel formed from the inner blank and the outer blank;

a multi-ply first side panel formed from the inner blank and the outer blank;

a multi-ply second end panel formed from the inner blank and the outer blank;

a multi-ply second side panel formed from the inner blank and the outer blank;

a top panel; and a bottom panel, wherein a lid pattern is formed at least in the first end panel, the lid pattern defining a pivotable lid and a latch, a base portion of the latch being formed in the outer blank and adhered to the inner blank, and wherein the inner blank forms a closed sleeve within the outer blank, and the inner blank comprises a tear-away pattern comprising a curved tear line disposed behind the first end panel and at least one tear line disposed behind the top panel that allows a portion of the inner blank adjacent to the pivotable lid to be removed from the inner blank to create a dispenser opening after opening the pivotable lid, and the inner blank comprises a pour spout section disposed behind the first end panel and for being generally adjacent the dispenser opening when the portion of the inner blank is removed to form the dispenser opening.

25. The carton of claim 24, wherein the pivotable lid comprises at least a portion of the first and second side panels and the top panel.

26. The carton of claim 25, wherein the lid pattern extends in the first and second side panels.

27. The carton of claim 24, wherein the inner blank comprises a directional pour spout pattern adjacent to the pivotable lid.

28. The carton of claim 24, wherein the lid pattern defines a tear strip.

29. The carton of claim 24, further comprising at least one handle formed from the outer blank, the at least one handle being movable away from the inner blank.

30. The carton of claim 24, wherein the bottom panel comprises a plurality of overlapped single-ply flaps.

31. The carton of claim 24, wherein at least a majority of the lid is not adhered to the inner blank.

32. A method of opening and reclosing a carton, comprising:

providing a carton according to claim 25;

tearing the outer blank along the lid pattern; and pivoting the lid open.

33. A method of opening and reclosing a carton, comprising:

providing a carton formed at least from an inner blank and an outer blank, the carton comprising:

a multi-ply first end panel formed from the inner blank and the outer blank;

a first side panel;

a second end panel;

a second side panel;

a top panel; and a bottom panel, wherein a lid pattern is formed at least in the first end panel, the lid pattern defining a latch and a pivotable lid, a base portion of the latch being formed in the outer blank and adhered to the inner blank;

tearing the outer blank along the lid pattern, wherein the base portion separates from the lid during the tearing and leaves a latch aperture in the lid;

pivoting the lid open;

pivoting the lid closed; and engaging the latch in the latch aperture.

* * * * *